US008932457B2

(12) United States Patent
Xu et al.

(10) Patent No.: US 8,932,457 B2
(45) **Date of Patent: *Jan. 13, 2015**

(54) CATALYTIC CONVERSION METHOD FOR INCREASING CETANE NUMBER BARREL OF DIESEL

(75) Inventors: Youhao Xu, Beijing (CN); Jianhong Gong, Beijing (CN); Congli Cheng, Beijing (CN); Shouye Cui, Beijing (CN); Zhihai Hu, Beijing (CN); Yun Chen, Beijing (CN)

(73) Assignees: China Petroleum & Chemical Corporation, Beijing (CN); Research Institute of Petroleum Processing, Sinopec, Beijing (CN)

( * ) Notice: Subject to any disclaimer, the term of this patent is extended or adjusted under 35 U.S.C. 154(b) by 256 days.

This patent is subject to a terminal disclaimer.

(21) Appl. No.: 13/503,529

(22) PCT Filed: Oct. 20, 2010

(86) PCT No.: PCT/CN2010/001645

§ 371 (c)(1), (2), (4) Date: May 23, 2012

(87) PCT Pub. No.: WO2011/047540

PCT Pub. Date: Apr. 28, 2011

(65) Prior Publication Data

US 2013/0001129 A1 Jan. 3, 2013

(30) Foreign Application Priority Data

| | | |
|---|---|---|
| Oct. 22, 2009 | (CN) | 2009 1 0180775 |
| Oct. 22, 2009 | (CN) | 2009 1 0180776 |
| Nov. 26, 2009 | (CN) | 2009 1 0224271 |
| Nov. 26, 2009 | (CN) | 2009 1 0224272 |

(51) Int. Cl.
*C10G 11/05* (2006.01)
*C10G 51/02* (2006.01)

(Continued)

(52) U.S. Cl.
CPC ..... *C10G 11/05* (2013.01); *C10G 69/04* (2013.01); *C10L 1/08* (2013.01); *C10G 45/08*

(Continued)

(58) Field of Classification Search
CPC ..... C10G 11/05; C10G 11/18; C10G 11/182; C10G 45/08; C10G 45/12; C10G 51/00; C10G 51/02; C10G 51/026; C10G 55/00; C10G 55/02; C10G 55/06; C10G 69/00; C10G 69/04; C10G 2300/1037; C10G 2300/307; C10G 2400/02; C10G 2400/04
USPC ..... 208/46, 49, 67, 68, 69, 70, 72, 74, 106, 208/113, 120.3, 209, 212
See application file for complete search history.

(56) References Cited

U.S. PATENT DOCUMENTS

| | | | |
|---|---|---|---|
| 4,871,444 | A | 10/1989 | Chen et al. |
| 5,171,916 | A | 12/1992 | Le et al. |

(Continued)

FOREIGN PATENT DOCUMENTS

| | | | |
|---|---|---|---|
| CN | 1237477 | A | 12/1999 |
| CN | 1289832 | A | 4/2001 |

(Continued)

OTHER PUBLICATIONS

Cerqueira, et al., Deactivation of FCC Catalysts, Journal of Molecular Catalysis A: Chemical, 2008, vol. 292, p. 1-13.*

*Primary Examiner* — Walter D Griffin
*Assistant Examiner* — Derek Mueller
(74) *Attorney, Agent, or Firm* — Novick, Kim & Lee, PLLC; Allen Xue

(57) ABSTRACT

A catalytic conversion process uses a catalytic cracking catalyst having a relatively homogeneous activity containing mainly large pore zeolites in a catalytic conversion reactor. The reaction temperature, residence time of oil vapors and weight ratio of the catalyst/feedstock oil are sufficient to obtain a reaction product containing from about 12 to about 60% by weight of a fluid catalytic cracking gas oil relative to the weight of the feed stock oil and containing a diesel. The reaction temperature ranges from about 420° C. to about 550° C. The residence time of oil vapors ranges from about 0.1 to about 5 seconds. The weight ratio of the catalytic cracking catalyst/feedstock is about 1-about 10.

25 Claims, 2 Drawing Sheets

(51) Int. Cl.

| | |
|---|---|
| ***C10G 69/04*** | (2006.01) |
| ***C10L 1/08*** | (2006.01) |
| ***C10G 45/08*** | (2006.01) |
| ***C10G 45/12*** | (2006.01) |
| ***C10G 69/00*** | (2006.01) |
| ***C10L 1/06*** | (2006.01) |
| ***C10G 11/18*** | (2006.01) |

(52) U.S. Cl.

CPC ..... (2013.01); *C10G 45/12* (2013.01); *C10G 51/026* (2013.01); *C10G 69/00* (2013.01); *C10L 1/06* (2013.01); *C10G 11/18* (2013.01); *C10G 2300/307* (2013.01); *C10G 2300/4081* (2013.01); *C10G 2300/1037* (2013.01); *C10G 2300/107* (2013.01); *C10G 2300/1077* (2013.01); *C10G 2300/301* (2013.01); *C10G 2300/4006* (2013.01); *C10G 2300/4012* (2013.01); *C10G 2400/02* (2013.01); *C10G 2400/04* (2013.01)

USPC ..... 208/120.3; 208/113; 208/118; 208/119; 208/67

(56) References Cited

U.S. PATENT DOCUMENTS

| | | | | |
|---|---|---|---|---|
| 5,543,036 | A | 8/1996 | Chang et al. | |
| 5,788,834 | A | 8/1998 | Lapinski | |
| 2005/0279670 | A1 | 12/2005 | Long et al. | |
| 2011/0000818 | A1 * | 1/2011 | Xu et al. | 208/70 |

FOREIGN PATENT DOCUMENTS

| | | | | |
|---|---|---|---|---|
| CN | 1400284 | A | 3/2003 | |
| CN | 1473908 | A | 2/2004 | |
| CN | 1160441 | C | 8/2004 | |
| CN | 1566278 | A | 1/2005 | |
| CN | 1683474 | A | 10/2005 | |
| CN | 1896192 | A | 1/2007 | |
| CN | 1900226 | A | 1/2007 | |
| CN | 1965059 | A | 5/2007 | |
| CN | 101171063 | A | 4/2008 | |
| CN | 101362959 | A | 2/2009 | |
| CN | 101531924 | A | 9/2009 | |
| CN | 101724431 | A | 6/2010 | |
| CN | 102041093 | A | 5/2011 | |
| WO | 0040676 | A1 | 7/2000 | |
| WO | WO/2009/111953 | * | 9/2009 | C10G 11/18 |

* cited by examiner

CATALYTIC CONVERSION METHOD FOR INCREASING CETANE NUMBER BARREL OF DIESEL

FIELD OF THE INVENTION

The present invention relates to a catalytic conversion process. Specifically, the present invention relates to a catalytic conversion process for the maximum conversion of heavy feedstocks into high cetane number diesel.

BACKGROUND OF THE INVENTION

The global demands for high quality diesel are increasingly stepped up, while the demands for the fuel oils are decreasing. On the whole, the growth speed of the global demands for diesel will go beyond that on gasoline, although the area demands vary. Therefore, more and more light diesels with low cetane number produced by catalytic cracking (FCC) are being used as the harmonic component of diesel. In order to satisfy the demands for high quality diesel, it is necessary to modify the FCC light diesel, or produce high quality FCC light diesel with high output by FCC.

In the prior art, the processes for modifying the catalytic light diesel primarily include hydrogenation and alkylation. U.S. Pat. No. 5,543,036 discloses a process for modifying the FCC recycled light oil by hydrogenation. CN1289832A also discloses a process by hydrogenation for modifying the catalytically cracked diesel, comprising, under the hydrogenation conditions, passing the feedstocks in turn through the hydrotreating catalyst and the hydrocracking catalyst in single-stage series without any intermediate separation. Due to said process, the cetane number of the diesel fraction in the product is increased by 10 units as compared with the feedstocks, and the sulfur content and nitrogen content are notably decreased. U.S. Pat. No. 4,871,444 discloses a process for increasing the cetane number of a FCC recycled light oil, comprising the alkylation of the FCC recycled light oil with a linear alkylene having 3 to 9 carbon atoms in the presence of solid acid catalyst. U.S. Pat. No. 5,171,916 discloses a process for modifying a FCC recycled light oil, comprising the alkylation of the FCC recycled light oil with $\alpha$-$C_{1-4}$ alkylene or coker gas oil on a solid acid catalyst.

Another process of enhancing the quality of catalytic light diesel directly is achieved by varying the processing parameters or catalysts of the catalytic cracking CN1900226A discloses a catalytic cracking promoter for producing more diesel and a process for preparing the same. By the addition of a certain amount of such promoter, the diesel yield of FCC catalytic unit will be increased, and the product distribution will be improved without any change of the catalyst initially used in the refining unit. However, such process does not mention any improvement in the properties of diesel. CN1683474A also involves a catalytic cracking promoter for producing more diesel and a process for preparing the same. CN1473908A relates to a process for producing diesel from heavy oil and residue with $Ca^{2+}$-EDTA catalytic cracking. CN101171063A relates to a fluidized catalytic cracking (FCC) process for improving the quality of the distillate useful as harmonic oil of a diesel fuel. The FCC process combines the stage FCC conversion with the interstage separation of the multi-cyclic arene species. The reaction zones with lower and higher severities and selective separation of molecules in the riser of the FCC reactor together increase the outputs of the distillate with high diesel quality. The process emphasizes to obtain a saturated hydrocarbon enriched diesel fraction with high cetane number by a membrane separation.

Another process to enhance the quality of the catalytic light diesel uses the duplex combination of hydrogenation and catalytic cracking. For example, CN1896192A feeds the wax oil together with the recycled catalytically cracked heavy oil and the catalytically cracked light diesel into a hydrogenation unit, and feeds the hydrogenation tail oil into a catalytic cracking unit. The process can reduce the contents of aromatics and sulfur in the diesel, and increase the cetane number thereof. CN1382776A involves a process combining the hydrogenation of residues and the catalytic cracking of heavy oils. The processes in above patents do not set requirements on the procedures of catalytic cracking, but modify the diesel by hydrogenation.

CN101362959A discloses a catalytic conversion process for producing propylene and a gasoline with high octane number, comprising contacting the raw materials difficult to be cracked with a thermo-regenerated catalyst and conducting the cracking reaction under the conditions of: a temperature between 600 and 750° C., a weight hourly space velocity between 100 and 800 $h^{-1}$, a pressure between 0.10 and 1.0 MPa, a ratio of the catalyst to the raw materials between 30 and 150, a ratio of the steam to the raw materials between 0.05 and 1.0; mixing the reaction stream with the raw materials easy to be cracked and conducting the cracking reaction under the conditions of: a temperature between 450 and 620° C., a weight hourly space velocity between 0.1 and 100 $h^{-1}$, a pressure between 0.10 and 1.0 MPa, a ratio of the catalyst to the raw materials between 1.0 and 30, a ratio of the steam to the raw materials between 0.05 and 1.0; separating the spent catalyst and the reaction oil vapors, followed by feeding the spent catalyst into a stripper, stripping and coke-burning the catalyst, and recycling the regenerated catalyst to the reactor; and separating the reaction oil vapors to obtain the propylene and gasoline with high octane number as the target products, as well as re-cracked raw materials. The re-cracked raw materials comprise a fraction with distillation range of from 180 to 260° C. and a raffinate of heavy aromatics. The yield and selectivity for propylene are much increased by the process, and the yield of gasoline and the octane number are also increased significantly. The yield of dry gas decreases by 80% by weight or more.

SUMMARY OF THE INVENTION

The object of the present invention is to provide a process for the maximum conversion of heavy feedstocks into high cetane number diesel, with both increased cetane number of the diesel and increased yield of the diesel, i.e., the increased cetane barrel of the diesel, wherein the term "cetane barrel" means the product of the cetane number of the diesel and the yield of the diesel. The present invention primarily relates to selectively cracking hydrocarbons in the catalytic feedstocks, such as alkanes, alkyl side chains and the like, minimizing at the same time the entry of aromatics in the feedstocks into the diesel fractions, avoiding other components in the product from retention in the diesel fractions by producing aromatics via aromatization and the like. While the feedstocks are cracked into high cetane number diesel, the dry gas and coke yields are significantly reduced, thereby achieving the efficient utilization of petroleum resources.

In one aspect of the present invention, the present invention provides a catalytic conversion process for increasing the cetane barrel of the diesel, wherein the feedstock oil is contacted with a catalyst having a relatively homogeneous activity containing mainly the large pore zeolites in a catalytic conversion reactor, wherein the reaction temperature, oil vapors residence time and weight ratio of the catalyst/feedstock oil are sufficient to obtain a reaction product containing a diesel, and from about 12 to about 60% by weight of a fluid catalytic cracking gas oil (FGO) relative to the weight of the feedstock oil; the reaction temperature ranges from about 420° C. to about 550° C.; the oil vapors residence time ranges from about 0.1 to about 5 seconds; the weight ratio of the catalytic cracking catalyst/feedstock oil is about 1-about 10.

In a more preferred embodiment, the reaction temperature ranges from about 430° C. to about 500° C., preferably from about 430° C. to about 480° C.

In a more preferred embodiment, the oil vapors residence time ranges from about 0.5 to about 4 seconds, preferably from about 0.8 to about 3 seconds.

In a more preferred embodiment, the weight ratio of catalyst/feedstock oil is from about 2 to about 8, preferably from about 3 to about 6.

In a more preferred embodiment, the reaction pressure ranges from about 0.10 MPa to about 1.0 MPa, preferably from about 0.15 MPa to about 0.6 MPa.

In a more preferred embodiment, the feedstock oil is selected from or comprises petroleum hydrocarbons and/or other mineral oils, wherein petroleum hydrocarbons are selected from the group consisting of vacuum gas oil, atmospheric gas oil, coker gas oil, deasphalted oil, vacuum residue and atmospheric residue or mixture of two or more (including two, the same below); other mineral oils are selected from the group consisting of coal liquefied oil, oil sand oil and shale oil, or mixture of two or more.

In a more preferred embodiment, the catalyst containing mainly the large pore zeolites comprises zeolites, inorganic oxides and clays respectively in an amount of from about 5 to about 50 wt %, preferably about 10 to about 30 wt % of the zeolites; from about 0.5 to about 50 wt % of the inorganic oxides; and from 0 to about 70 wt % of the clays, relative to the total weight of the catalyst on a dry basis, wherein the zeolite is used as the active component and is selected from large pore zeolites. Large pore zeolites are selected from one or more of rare earth Y, rare earth H—Y, ultra-stable Y obtained by various methods, and high-silica Y.

The inorganic oxide as the substrate is selected from the group consisting of $SiO_2$ and/or $Al_2O_3$. On a dry basis, the inorganic oxide comprises about 50 to about 90 wt % of silica, and about 10 to about 50 wt % of alumina.

The clay as the binder is one or more selected from the group consisting of kaolin, meta halloysite, montmorillonite, diatomite, halloysite, saponite, rectorite, sepiolite, attapulgite, hydrotalcite, and bentonite.

The catalyst having a relatively homogeneous activity (including the catalytic cracking catalyst and the catalyst for producing more diesel) has an initial activity of not higher than about 80, preferably not higher than about 75, more preferably not higher than about 70, a self-balancing time ranging from about 0.1 h to about 50 h, preferably from about 0.2 h to about 30 h, more preferably from about 0.5 h to about 10 h, and an equilibrium activity ranging from about 35 to about 60, preferably from about 40 to about 55.

Said initial activity of the catalyst or the fresh catalyst activity as mentioned below means the catalyst activity evaluated by the light oil micro-reaction unit. It can be measured by the measuring method in the prior art: Enterprise standard RIPP 92-90-Micro-reaction activity test for catalytic cracking fresh catalysts, *Petrochemical analytic method* (*RIPP test method*), Yang Cuiding et al, 1990 (hereinafter referred to as RIPP 92-90). The initial activity of the catalyst is represented by light oil micro-reaction activity (MA), calculated by the formula MA=(output of the gasoline having a temperature less than 204° C. in the product+gas output+coke output)/total weight of the feedstock oil×100%=the yield of the gasoline having a temperature less than 204° C. in the product+gas yield+coke yield. The evaluation conditions of the light oil micro-reaction unit (by reference to RIPP 92-90) include pulverizing the catalyst into particles having a particle diameter of about 420-841 μm; the weight being 5 g; the reaction feedstocks being straightrun light diesel fuel having a distillation range of 235-337° C.; the reaction temperature being 460° C.; the weight hourly space velocity being 16 $h^{-1}$; and the catalyst/oil ratio being 3.2.

The self-balancing time of the catalyst is the time necessary for achieving the equilibrium activity by ageing at 800° C. and 100% water vapor (by reference to RIPP 92-90).

The catalyst having a relatively homogeneous activity is obtainable by, for example, the following three processing methods.

The Catalyst-Processing Method 1:

(1) loading a fresh catalyst into a fluidized bed, preferably a dense phase fluidized bed, contacting with water vapor, ageing under a certain hydrothermal circumstance to obtain a catalyst having a relatively homogeneous activity; and (2) loading the catalyst having a relatively homogeneous activity into the corresponding reaction unit.

The processing method 1 is specifically carried out, for example, as follows.

A fresh catalyst is loaded into a fluidized bed, preferably a dense phase fluidized bed, and water vapor is fed into the bottom of the fluidized bed. The fluidization of the catalyst is achieved under the action of water vapor, and the catalyst is aged by water vapor at the same time to obtain the catalyst having a relatively homogeneous activity. The ageing temperature ranges from about 400° C. to about 850° C., preferably from about 500° C. to about 750° C., more preferably from about 600° C. to about 700° C. The superficial linear velocity of the fluidized bed ranges from about 0.1 to about 0.6 m/s, preferably from about 0.15 to about 0.5 m/s. The ageing time ranges from about 1 h to about 720 h, preferably from about 5 h to about 360 h. According to the requirements on the industrial unit, the catalyst having a relatively homogeneous activity is loaded into the industrial unit, preferably into the regenerator of the industrial unit.

The Catalyst-Processing Method 2:

(1) loading a fresh catalyst into a fluidized bed, preferably a dense phase fluidized bed, contacting with an ageing medium containing water vapor, ageing under a certain hydrothermal circumstance to obtain a catalyst having a relatively homogeneous activity; and (2) loading the catalyst having a relatively homogeneous activity into the corresponding reaction unit.

The technical solution of the catalyst-processing method 2 is specifically carried out, for example, as follows.

A catalyst is loaded into a fluidized bed, preferably a dense phase fluidized bed, and an ageing medium containing water vapor is fed into the bottom of the fluidized bed. The fluidization of the catalyst is achieved under the action of the ageing medium containing water vapor, and the catalyst is aged by the ageing medium containing water vapor at the same time to obtain the catalyst having a relatively homogeneous activity. The ageing temperature ranges from about 400° C. to about 850° C., preferably from about 500° C. to about 750° C., more preferably from about 600° C. to about 700° C. The superficial linear velocity of the fluidized bed ranges from about 0.1 to about 0.6 m/s, preferably from about 0.15 to about 0.5 m/s. The weight ratio of water vapor to the ageing medium ranges from about 0.20 to about 0.9, preferably from about 0.40 to about 0.60. The ageing time ranges from about 1 h to about 720 h, preferably from about 5 h to about 360 h. According to the requirements on the industrial unit, the catalyst having a relatively homogeneous activity is loaded into the industrial unit, preferably into the regenerator of the industrial unit. The ageing medium comprises air, dry gas, regenerated flue gas, gas obtained by combusting air and dry gas or gas obtained by combusting air and burning oil, or other gases such as nitrogen gas. The weight ratio of water vapor to ageing medium ranges from about 0.2 to about 0.9, preferably from about 0.40 to about 0.60.

The catalyst-processing method 3:

(1) loading a fresh catalyst into a fluidized bed, preferably a dense phase fluidized bed, feeding the hot regenerated catalyst in the regenerator into the fluidized bed, and conducting heat exchanging in the fluidized bed;

(2) contacting the heat exchanged fresh catalyst with water vapor or the ageing medium containing water vapor, ageing under a certain hydrothermal circumstance to obtain a catalyst having a relatively homogeneous activity; and (3) loading the catalyst having a relatively homogeneous activity into the corresponding reaction unit.

The technical solution of the present invention is specifically carried out, for example, as follows.

A fresh catalyst is loaded into a fluidized bed, preferably a dense phase fluidized bed, and the hot regenerated catalyst in the regenerator is loaded into the fluidized bed at the same time to conduct heat exchanging in the fluidized bed. Water vapor or an ageing medium containing water vapor is fed into the bottom of the fluidized bed. The fluidization of the fresh catalyst is achieved under the action of water vapor or the ageing medium containing water vapor, and the fresh catalyst is aged by water vapor or the ageing medium containing water vapor at the same time to obtain the catalyst having a relatively homogeneous activity. The ageing temperature ranges from about 400° C. to about 850° C., preferably from about 500° C. to about 750° C., more preferably from about 600° C. to about 700° C. The superficial linear velocity of the fluidized bed ranges from about 0.1 to about 0.6 m/s, preferably from about 0.15 to about 0.5 m/s. The ageing time ranges from about 1 h to about 720 h, preferably from about 5 h to about 360 h. Under the circumstance of the ageing medium containing water vapor, the weight ratio of water vapor to the ageing medium ranges from greater than about 0 to about 4, preferably from about 0.5 to about 1.5. According to the requirements on the industrial unit, the catalyst having a relatively homogeneous activity is loaded into the industrial unit, preferably into the regenerator of the industrial unit. In addition, water vapor after the ageing step is fed into the reaction system (as one or more selected from the group consisting of stripping steam, anticoking steam, atomizing steam and lifting steam, and added into the stripper, settler, feedstock nozzle and prelifting zone of the catalytic cracking unit respectively) or the regeneration system. The ageing medium containing water vapor after the ageing step is fed into the regeneration system, and the heat exchanged regenerated catalyst is recycled back to the regenerator. The ageing medium comprises air, dry gas, regenerated flue gas, gas obtained by combusting air and dry gas or gas obtained by combusting air and burning oil, or other gases such as nitrogen gas.

By the aforesaid processing methods, the activity and selectivity distribution of the catalyst in the industrial reaction unit are more homogeneous; the selectivity of the catalyst is notably improved so as to decrease the dry gas and coke yields significantly.

The particle size distribution of the catalyst may be the particle size distribution of the conventional catalytic cracking catalyst or a coarse particle size distribution. In a more preferred embodiment, the catalyst is characterized in using the catalyst having a coarse particle size distribution.

The catalyst having a coarse particle size distribution comprise less than about 10 vol. %, preferably less than about 5 vol. % of the particles having a particle size of less than 40 μm relative to the volume of all the particles; less than about 15 vol. %, preferably less than about 10 vol. % of the particles having a particle size of greater than 80 μm relative to the volume of all the particles, and the remaining being the particles having a particle size of from 40 to 80 μm.

In a more preferred embodiment, the reactor is one or more selected from the group consisting of a riser, a fluidized bed with an equal linear velocity, a fluidized bed with an equal diameter, an upstream conveyor line and a downstream conveyor line or combinations thereof, or combinations of two or more same reactors, wherein the combinations comprises combinations in series or/and parallel; the riser is a conventional one with an equal diameter or various risers with variable diameters.

In a more preferred embodiment, the feedstock oil is fed into the reactor at one position, or at more than one positions at the same or different heights.

In a more preferred embodiment, the process further comprises separating the reaction product from the catalyst, stripping and coke-burning the spent catalyst and recycling it to the reactor, wherein the separated product comprises diesel having high cetane number and fluid catalytic cracking gas oil.

In a more preferred embodiment, the fluid catalytic cracking gas oil is a fraction having an initial boiling point of not less than 330° C. and a hydrogen content of not less than 10.8 wt %.

In a more preferred embodiment, the fluid catalytic cracking gas oil is a fraction having an initial boiling point of not less than 350° C. and a hydrogen content of not less than 11.5 wt %.

In another aspect of the present invention, the present invention provides a catalytic conversion process for increasing the cetane barrel of diesel, wherein the process comprises contacting the feedstock oil with a catalytic cracking catalyst having a relatively homogeneous activity containing mainly the large pore zeolites in a catalytic conversion reactor, wherein the reaction temperature, oil vapors residence time and weight ratio of the catalyst/feedstock oil are sufficient to obtain a reaction product containing a diesel, and from about 12 to about 60% by weight of a fluid catalytic cracking gas oil relative to the weight of the feedstock oil; the reaction temperature ranges from about 420° C. to about 550° C.; the oil vapors residence time ranges from about 0.1 to about 5 seconds; the weight ratio of the catalytic cracking catalyst/feedstock oil is about 1-about 10; and introducing all or a part of the fluid catalytic cracking gas oil into a conventional catalytic cracking reactor or a riser with variable diameters to further produce a product comprising diesel and gasoline, and/or introducing the fluid catalytic cracking gas oil back to the initial catalytic conversion reactor or feeding it into another catalytic conversion reactor.

In a more preferred embodiment, the reaction temperature ranges from about 430° C. to about 500° C., preferably from about 430° C. to about 480° C.

In a more preferred embodiment, the oil vapors residence time ranges from about 0.5 to about 4 seconds, preferably from about 0.8 to about 3 seconds.

In a more preferred embodiment, the weight ratio of catalyst/feedstock oil is from about 2 to about 8, preferably from about 3 to about 6.

In a more preferred embodiment, the reaction pressure ranges from about 0.10 MPa to about 1.0 MPa, preferably from about 0.15 MPa to about 0.6 MPa.

In a more preferred embodiment, the feedstock oil is selected from or comprises petroleum hydrocarbons and/or other mineral oils, wherein petroleum hydrocarbons are selected from the group consisting of vacuum gas oil, atmospheric gas oil, coker gas oil, deasphalted oil, vacuum residue and atmospheric residue or mixture of two or more; other mineral oils are selected from the group consisting of coal liquefied oil, oil sand oil and shale oil, or mixture of two or more.

In a more preferred embodiment, the catalyst containing mainly the large pore zeolites comprises zeolites, inorganic oxides and clays respectively in an amount of from about 5 to about 50 wt %, preferably about 10 to about 30 wt % of the zeolites; from about 0.5 to about 50 wt % of the inorganic oxides; and from 0 to about 70 wt % of the clays, relative to the total weight of the catalyst on a dry basis, wherein the zeolite is used as the active component and is selected from large pore zeolites. Large pore zeolites are selected from one or more of rare earth Y, rare earth hydrogen Y, ultra-stable Y obtained by various methods, and high-silica Y.

The inorganic oxide as the substrate is selected from the group consisting of $SiO_2$ and/or $Al_2O_3$. On a dry basis, the inorganic oxide comprises about 50 to about 90 wt % of silica, and about 10 to about 50 wt % of alumina.

The clay as the binder is one or more selected from the group consisting of kaolin, meta halloysite, montmorillonite, diatomite, halloysite, saponite, rectorite, sepiolite, attapulgite, hydrotalcite, and bentonite.

The catalyst having a relatively homogeneous activity (including the catalytic cracking catalyst and the catalyst for producing more diesel) has an initial activity of not higher than about 80, preferably not higher than about 75, more preferably not higher than about 70, a self-balancing time ranging from about 0.1 h to about 50 h, preferably from about 0.2 h to about 30 h, more preferably from about 0.5 h to about 10 h, and an equilibrium activity ranging from about 35 to about 60, preferably from about 40 to about 55.

Said initial activity of the catalyst or the fresh catalyst activity as mentioned below means the catalyst activity evaluated by the light oil micro-reaction unit. It can be measured by the measuring method in the prior art: Enterprise standard RIPP 92-90-Micro-reaction activity test for catalytic cracking fresh catalysts, *Petrochemical analytic method* (*RIPP test method*), Yang Cuiding et al, 1990 (hereinafter referred to as RIPP 92-90). The initial activity of the catalyst is represented by light oil micro-reaction activity (MA), calculated by the formula MA=(output of the gasoline having a temperature less than 204° C. in the product+gas output+coke output)/total weight of the feedstock oil×100%=the yield of the gasoline having a temperature less than 204° C. in the product+gas yield+coke yield. The evaluation conditions of the light oil micro-reaction unit (by reference to RIPP 92-90) include pulverizing the catalyst into particles having a particle diameter of about 420-841 μm; the weight being 5 g; the reaction feedstocks being straightrun light diesel fuel having a distillation range of 235-337° C.; the reaction temperature being 460° C.; the weight hourly space velocity being 16 $h^{-1}$; and the catalyst/oil ratio being 3.2.

The self-balancing time of the catalyst is the time necessary for achieving the equilibrium activity by ageing at 800° C. and 100% water vapor (by reference to RIPP 92-90).

The catalyst having a relatively homogeneous activity is obtainable by, for example, the following three processing methods.

The Catalyst-Processing Method 1:

(1) loading a fresh catalyst into a fluidized bed, preferably a dense phase fluidized bed, contacting with water vapor, ageing under a certain hydrothermal circumstance to obtain a catalyst having a relatively homogeneous activity; and (2) loading the catalyst having a relatively homogeneous activity into the corresponding reaction unit.

The processing method 1 is specifically carried out, for example, as follows.

A fresh catalyst is loaded into a fluidized bed, preferably a dense phase fluidized bed, and water vapor is fed into the bottom of the fluidized bed. The fluidization of the catalyst is achieved under the action of water vapor, and the catalyst is aged by water vapor at the same time to obtain the catalyst having a relatively homogeneous activity. The ageing temperature ranges from about 400° C. to about 850° C., preferably from about 500° C. to about 750° C., more preferably from about 600° C. to about 700° C. The superficial linear velocity of the fluidized bed ranges from about 0.1 to about 0.6 m/s, preferably from about 0.15 to about 0.5 m/s. The ageing time ranges from about 1 h to about 720 h, preferably from about 5 h to about 360 h. According to the requirements on the industrial unit, the catalyst having a relatively homogeneous activity is loaded into the industrial unit, preferably into the regenerator of the industrial unit.

The Catalyst-Processing Method 2:

(1) loading a fresh catalyst into a fluidized bed, preferably a dense phase fluidized bed, contacting with an ageing medium containing water vapor, ageing under a certain hydrothermal circumstance to obtain a catalyst having a relatively homogeneous activity; and (2) loading the catalyst having a relatively homogeneous activity into the corresponding reaction unit.

The technical solution of the catalyst-processing method 2 is specifically carried out, for example, as follows.

A catalyst is loaded into a fluidized bed, preferably a dense phase fluidized bed, and an ageing medium containing water vapor is fed into the bottom of the fluidized bed. The fluidization of the catalyst is achieved under the action of the ageing medium containing water vapor, and the catalyst is aged by the ageing medium containing water vapor at the same time to obtain the catalyst having a relatively homogeneous activity. The ageing temperature ranges from about 400° C. to about 850° C., preferably from about 500° C. to about 750° C., more preferably from about 600° C. to about 700° C. The superficial linear velocity of the fluidized bed ranges from about 0.1 to about 0.6 m/s, preferably from about 0.15 to about 0.5 m/s. The weight ratio of water vapor to the ageing medium ranges from about 0.20 to about 0.9, preferably from about 0.40 to about 0.60. The ageing time ranges from about 1 h to about 720 h, preferably from about 5 h to about 360 h. According to the requirements on the industrial unit, the catalyst having a relatively homogeneous activity is loaded into the industrial unit, preferably into the regenerator of the industrial unit. The ageing medium comprises air, dry gas, regenerated flue gas, gas obtained by combusting air and dry gas or gas obtained by combusting air and burning oil, or other gases such as nitrogen gas. The weight ratio of water vapor to ageing medium ranges from about 0.2 to about 0.9, preferably from about 0.40 to about 0.60.

The Catalyst-Processing Method 3:

(1) loading a fresh catalyst into a fluidized bed, preferably a dense phase fluidized bed, feeding the hot regenerated catalyst in the regenerator into the fluidized bed, and conducting heat exchanging in the fluidized bed;

(2) contacting the heat exchanged fresh catalyst with water vapor or the ageing medium containing water vapor, ageing under a certain hydrothermal circumstance to obtain a catalyst having a relatively homogeneous activity; and (3) loading the catalyst having a relatively homogeneous activity into the corresponding reaction unit.

The technical solution of the present invention is specifically carried out, for example, as follows.

A fresh catalyst is loaded into a fluidized bed, preferably a dense phase fluidized bed, and the hot regenerated catalyst in the regenerator is loaded into the fluidized bed at the same time to conduct heat exchanging in the fluidized bed. Water vapor or an ageing medium containing water vapor is fed into the bottom of the fluidized bed. The fluidization of the fresh catalyst is achieved under the action of water vapor or the ageing medium containing water vapor, and the fresh catalyst is aged by water vapor or the ageing medium containing water vapor at the same time to obtain the catalyst having a relatively homogeneous activity. The ageing temperature ranges from about 400° C. to about 850° C., preferably from about 500° C. to about 750° C., more preferably from about 600° C. to about 700° C. The superficial linear velocity of the fluidized bed ranges from about 0.1 to about 0.6 m/s, preferably from about 0.15 to about 0.5 m/s. The ageing time ranges from about 1 h to about 720 h, preferably from about 5 h to about 360 h. Under the circumstance of the ageing medium containing water vapor, the weight ratio of water vapor to the ageing medium ranges from greater than about 0 to about 4, preferably ranges from about 0.5 to about 1.5. According to the requirements on the industrial unit, the catalyst having a relatively homogeneous activity is loaded into the industrial unit, preferably into the regenerator of the industrial unit. In addition, water vapor after the ageing step is fed into the reaction system (as one or more selected from the group consisting of stripping steam, anticoking steam, atomizing steam and lifting steam, and added into the stripper, settler, feedstock nozzle and prelifting zone of the catalytic cracking unit respectively) or the regeneration system. The ageing medium containing water vapor after the ageing step is fed into the regeneration system, and the heat exchanged regenerated catalyst is recycled back to the regenerator. The ageing medium comprises air, dry gas, regenerated flue gas, gas obtained by combusting air and dry gas or gas obtained by combusting air and burning oil, or other gases such as nitrogen gas.

By the aforesaid processing methods, the activity and selectivity distribution of the catalyst in the industrial reaction unit are more homogeneous; the selectivity of the catalyst is notably improved so as to decrease the dry gas and coke yields significantly.

The particle size distribution of the catalyst may be the particle size distribution of the conventional catalytic cracking catalyst or a coarse particle size distribution. In a more preferred embodiment, the catalyst is characterized in using the catalyst having a coarse particle size distribution.

The catalyst having a coarse particle size distribution comprise less than about 10 vol. %, preferably less than about 5 vol. % of the particles having a particle size of less than 40 μm relative to the volume of all the particles; less than about 15 vol. %, preferably less than about 10 vol. % of the particles having a particle size of greater than 80 μm relative to the volume of all the particles, and the remaining being the particles having a particle size of from 40 to 80 μm.

The details of the riser reactor with variable diameters into which the fluid catalytic cracking gas oil is introduced may be reference to CN1237477A.

In a more preferred embodiment, the fluid catalytic cracking gas oil is fed into another conversion reactor for cracking reaction, the oil vapors produced is subjected to hydrogen transfer reaction and isomerization reaction under certain reaction environment, and a reaction product comprising low olefin gasoline is obtained through separation. The conversion reactor can be divided into two reaction zones, with the following reaction conditions for each reaction zone:

The first reaction zone serves predominantly for the cracking reaction, and has a reaction temperature ranging from about 480° C. to about 600° C., preferably from about 485° C. to about 580° C.; a reaction time ranging from about 0.1 to about 3 seconds, preferably about 0.5 to about 2 seconds; a ratio by weight of the severe conversion catalyst to the fluid catalytic cracking gas oil ranging from about 0.5:1 to about 25:1, preferably about 1:1 to about 15:1; a ratio by weight of the prelifting medium to the fluid catalytic cracking gas oil ranging from about 0.01:1 to about 2:1, preferably about 0.05:1 to about 1:1; a reaction pressure ranging from about 130 kPa to about 450 kPa, preferably about 250 kPa to about 400 kPa.

The second reaction zone serves predominantly for the hydrogen transfer reaction and isomerization reaction; and has a reaction temperature ranging from about 450° C. to about 550° C., preferably about 460° C. to about 530° C.; a dense phase operation being maintained in the second reaction zone; a density of the dense phase of the catalyst bed ranging from about 100 to about 700 kg/m$^3$, preferably from about 120 to about 500 kg/m$^3$; a weight hourly space velocity in the second reaction zone ranging from about 1 to about 50 hour$^{-1}$, preferably from about 1 to about 40 hour$^{-1}$; and a reaction pressure ranging from about 130 kPa to about 450 kPa, preferably about 250 kPa to about 400 kPa.

In a more preferred embodiment, the process further comprises separating the product of the another conversion reaction and the conversion catalyst, stripping and coke-burning the conversion catalyst and recycling it to the another conversion reactor, wherein the separated product comprises the low olefin gasoline and the like.

In a more preferred embodiment, the reactor is one or more selected from the group consisting of a riser, a fluidized bed with an equal linear velocity, a fluidized bed with an equal diameter, an upstream conveyor line and a downstream conveyor line or combinations thereof, or combinations of two or more same reactors, wherein the combinations comprises combinations in series or/and parallel; the riser is a conventional one with an equal diameter or various risers with variable diameters.

In a more preferred embodiment, the feedstock oil is fed into the reactor at one position, or at more than one positions at the same or different heights.

In a more preferred embodiment, the process further comprises separating the reaction product from the catalyst, stripping and coke-burning the spent catalyst and recycling it to the reactor, wherein the separated product comprises diesel having high cetane number and fluid catalytic cracking gas oil.

In a more preferred embodiment, the fluid catalytic cracking gas oil is a fraction having an initial boiling point of not less than 330° C. and a hydrogen content of not less than 10.8 wt %.

In a more preferred embodiment, the fluid catalytic cracking gas oil is a fraction having an initial boiling point of not less than 350° C. and a hydrogen content of not less than 11.5 wt %.

In another aspect of the present invention, the present invention provides a catalytic conversion process for increasing the cetane barrel of diesel, wherein the process comprises contacting the feedstock oil with a catalytic cracking catalyst having a relatively homogeneous activity containing mainly the large pore zeolites in a catalytic conversion reactor, wherein the reaction temperature, oil vapors residence time and weight ratio of the catalyst/feedstock oil are sufficient to obtain a reaction product containing a diesel, and from about 12 to about 60% by weight of a fluid catalytic cracking gas oil relative to the weight of the feedstock oil; the reaction temperature ranges from about 420° C. to about 550° C.; the oil vapors residence time ranges from about 0.1 to about 5 seconds; the weight ratio of the catalytic cracking catalyst/feedstock oil is about 1-about 10; wherein all or a part of the fluid catalytic cracking gas oil is introduced into a hydrocracking unit for the further production of diesel having high cetane number.

In a preferred embodiment, the treated hydrocracked tail oil can be introduced into a conventional catalytic cracking reactor or a riser with variable diameters to further produce a product comprising diesel and gasoline. In a preferred embodiment, the hydrocracking tail oil can be introduced back to the catalytic conversion reactor In a more preferred embodiment, the reaction temperature ranges from about 430° C. to about 500° C., preferably from about 430° C. to about 480° C.

In a more preferred embodiment, the oil vapors residence time ranges from about 0.5 to about 4 seconds, preferably from about 0.8 to about 3 seconds.

In a more preferred embodiment, the weight ratio of catalyst/feedstock oil is from about 2 to about 8, preferably from about 3 to about 6.

In a more preferred embodiment, the reaction pressure ranges from about 0.10 MPa to about 1.0 MPa, preferably from about 0.15 MPa to about 0.6 MPa.

In a more preferred embodiment, the feedstock oil is selected from or comprises petroleum hydrocarbons and/or other mineral oils, wherein petroleum hydrocarbons are selected from the group consisting of vacuum gas oil, atmospheric gas oil, coker gas oil, deasphalted oil, vacuum residue and atmospheric residue or mixture of two or more; other mineral oils are selected from the group consisting of coal liquefied oil, oil sand oil and shale oil, or mixture of two or more.

In a more preferred embodiment, the catalyst containing mainly the large pore zeolites comprises zeolites, inorganic oxides and clays respectively in an amount of from about 5 to about 50 wt %, preferably about 10 to about 30 wt % of the zeolites; from about 0.5 to about 50 wt % of the inorganic oxides; and from 0 to about 70 wt % of the clays, relative to the total weight of the catalyst on a dry basis, wherein the zeolite is used as the active component and is selected from large pore zeolites. Large pore zeolites are selected from one or more of rare earth Y, rare earth H—Y, ultra-stable Y obtained by various methods, and high-silica Y.

The inorganic oxide as the substrate is selected from the group consisting of $SiO_2$ and/or $Al_2O_3$. On a dry basis, the inorganic oxide comprises about 50 to about 90 wt % of silica, and about 10 to about 50 wt % of alumina.

The clay as the binder is one or more selected from the group consisting of kaolin, meta halloysite, montmorillonite, diatomite, halloysite, saponite, rectorite, sepiolite, attapulgite, hydrotalcite, and bentonite.

The catalyst having a relatively homogeneous activity (including the catalytic cracking catalyst and the catalyst for producing more diesel) has an initial activity of not higher than about 80, preferably not higher than about 75, more preferably not higher than about 70, a self-balancing time ranging from about 0.1 h to about 50 h, preferably from about 0.2 h to about 30 h, more preferably from about 0.5 h to about 10 h, and an equilibrium activity ranging from about 35 to about 60, preferably from about 40 to about 55.

Said initial activity of the catalyst or the fresh catalyst activity as mentioned below means the catalyst activity evaluated by the light oil micro-reaction unit. It can be measured by the measuring method in the prior art: Enterprise standard RIPP 92-90-Micro-reaction activity test for catalytic cracking fresh catalysts, Petrochemical analytic method (RIPP test method), Yang Cuiding et al, 1990 (hereinafter referred to as RIPP 92-90). The initial activity of the catalyst is represented by light oil micro-reaction activity (MA), calculated by the formula MA=(output of the gasoline having a temperature less than 204° C. in the product+gas output+coke output)/total weight of the feedstock oil×100%=the yield of the gasoline having a temperature less than 204° C. in the product+gas yield+coke yield. The evaluation conditions of the light oil micro-reaction unit (by reference to RIPP 92-90) include pulverizing the catalyst into particles having a particle diameter of about 420-841 μm; the weight being 5 g; the reaction feedstocks being straightrun light diesel fuel having a distillation range of 235-337° C.; the reaction temperature being 460° C.; the weight hourly space velocity being 16 $h^{-1}$; and the catalyst/oil ratio being 3.2.

The self-balancing time of the catalyst is the time necessary for achieving the equilibrium activity by ageing at 800° C. and 100% water vapor (by reference to RIPP 92-90).

The catalyst having a relatively homogeneous activity is obtainable by, for example, the following three processing methods.

The Catalyst-Processing Method 1:

(1) loading a fresh catalyst into a fluidized bed, preferably a dense phase fluidized bed, contacting with water vapor, ageing under a certain hydrothermal circumstance to obtain a catalyst having a relatively homogeneous activity; and (2) loading the catalyst having a relatively homogeneous activity into the corresponding reaction unit.

The processing method 1 is specifically carried out, for example, as follows.

A fresh catalyst is loaded into a fluidized bed, preferably a dense phase fluidized bed, and water vapor is fed into the bottom of the fluidized bed. The fluidization of the catalyst is achieved under the action of water vapor, and the catalyst is aged by water vapor at the same time to obtain the catalyst having a relatively homogeneous activity. The ageing temperature ranges from about 400° C. to about 850° C., preferably from about 500° C. to about 750° C., more preferably from about 600° C. to about 700° C. The superficial linear velocity of the fluidized bed ranges from about 0.1 to about 0.6 m/s, preferably from about 0.15 to about 0.5 m/s. The ageing time ranges from about 1 h to about 720 h, preferably from about 5 h to about 360 h. According to the requirements on the industrial unit, the catalyst having a relatively homogeneous activity is loaded into the industrial unit, preferably into the regenerator of the industrial unit.

The Catalyst-Processing Method 2:

(1) loading a fresh catalyst into a fluidized bed, preferably a dense phase fluidized bed, contacting with an ageing medium containing water vapor, ageing under a certain hydrothermal circumstance to obtain a catalyst having a relatively homogeneous activity; and (2) loading the catalyst having a relatively homogeneous activity into the corresponding reaction unit.

The technical solution of the catalyst-processing method 2 is specifically carried out, for example, as follows.

A catalyst is loaded into a fluidized bed, preferably a dense phase fluidized bed, and an ageing medium containing water vapor is fed into the bottom of the fluidized bed. The fluidization of the catalyst is achieved under the action of the ageing medium containing water vapor, and the catalyst is aged by the ageing medium containing water vapor at the same time to obtain the catalyst having a relatively homogeneous activity. The ageing temperature ranges from about 400° C. to about 850° C., preferably from about 500° C. to about 750° C., more preferably from about 600° C. to about 700° C. The superficial linear velocity of the fluidized bed ranges from about 0.1 to about 0.6 m/s, preferably from about 0.15 to about 0.5 m/s. The weight ratio of water vapor to the ageing medium ranges from about 0.20 to about 0.9, preferably from about 0.40 to about 0.60. The ageing time ranges from about 1 h to about 720 h, preferably from about 5 h to about 360 h. According to the requirements on the industrial unit, the catalyst having a relatively homogeneous activity is loaded into the industrial unit, preferably into the regenerator of the industrial unit. The ageing medium comprises air, dry gas, regenerated flue gas, gas obtained by combusting air and dry gas or gas obtained by combusting air and burning oil, or other gases such as nitrogen gas. The weight ratio of water vapor to ageing medium ranges from about 0.2 to about 0.9, preferably from about 0.40 to about 0.60.

The Catalyst-Processing Method 3:

(1) loading a fresh catalyst into a fluidized bed, preferably a dense phase fluidized bed, feeding the hot regenerated catalyst in the regenerator into the fluidized bed, and conducting heat exchanging in the fluidized bed;

(2) contacting the heat exchanged fresh catalyst with water vapor or the ageing medium containing water vapor, ageing under a certain hydrothermal circumstance to obtain a catalyst having a relatively homogeneous activity; and (3) loading the catalyst having a relatively homogeneous activity into the corresponding reaction unit.

The technical solution of the present invention is specifically carried out, for example, as follows.

A fresh catalyst is loaded into a fluidized bed, preferably a dense phase fluidized bed, and the hot regenerated catalyst in the regenerator is loaded into the fluidized bed at the same time to conduct heat exchanging in the fluidized bed. Water vapor or an ageing medium containing water vapor is fed into the bottom of the fluidized bed. The fluidization of the fresh catalyst is achieved under the action of water vapor or the ageing medium containing water vapor, and the fresh catalyst is aged by water vapor or the ageing medium containing water vapor at the same time to obtain the catalyst having a relatively homogeneous activity. The ageing temperature ranges from about 400° C. to about 850° C., preferably from about 500° C. to about 750° C., more preferably from about 600° C. to about 700° C. The superficial linear velocity of the fluidized bed ranges from about 0.1 to about 0.6 m/s, preferably from about 0.15 to about 0.5 m/s. The ageing time ranges from about 1 h to about 720 h, preferably from about 5 h to about 360 h. Under the circumstance of the ageing medium containing water vapor, the weight ratio of water vapor to the ageing medium ranges from greater than about 0 to about 4, preferably ranges from about 0.5 to about 1.5. According to the requirements on the industrial unit, the catalyst having a relatively homogeneous activity is loaded into the industrial unit, preferably into the regenerator of the industrial unit. In addition, water vapor after the ageing step is fed into the reaction system (as one or more selected from the group consisting of stripping steam, anticoking steam, atomizing steam and lifting steam, and added into the stripper, settler, feedstock nozzle and prelifting zone of the catalytic cracking unit respectively) or the regeneration system. The ageing medium containing water vapor after the ageing step is fed into the regeneration system, and the heat exchanged regenerated catalyst is recycled back to the regenerator. The ageing medium comprises air, dry gas, regenerated flue gas, gas obtained by combusting air and dry gas or gas obtained by combusting air and burning oil, or other gases such as nitrogen gas.

By the aforesaid processing methods, the activity and selectivity distribution of the catalyst in the industrial reaction unit are more homogeneous; the selectivity of the catalyst is notably improved so as to decrease the dry gas and coke yields significantly.

The particle size distribution of the catalyst may be the particle size distribution of the conventional catalytic cracking catalyst or a coarse particle size distribution. In a more preferred embodiment, the catalyst is characterized in using the catalyst having a coarse particle size distribution.

The catalyst having a coarse particle size distribution comprise less than about 10 vol. %, preferably less than about 5 vol. % of the particles having a particle size of less than 40 μm relative to the volume of all the particles; less than about 15 vol. %, preferably less than about 10 vol. % of the particles having a particle size of greater than 80 μm relative to the volume of all the particles, and the remaining being the particles having a particle size of from 40 to 80 μm.

The details of the riser reactor with variable diameters into which the fluid catalytic cracking gas oil is introduced may be by reference to CN1237477A.

In a more preferred embodiment, the reactor is one or more selected from the group consisting of a riser, a fluidized bed with an equal linear velocity, a fluidized bed with an equal diameter, an upstream conveyor line and a downstream conveyor line or combinations thereof, or combinations of two or more same reactors, wherein the combinations comprises combinations in series or/and parallel; the riser is a conventional one with an equal diameter or various risers with variable diameters.

In a more preferred embodiment, the feedstock oil is fed into the reactor at one position, or at more than one positions at the same or different heights.

In a more preferred embodiment, the process further comprises separating the reaction product from the catalyst, stripping and coke-burning the spent catalyst and recycling it to the reactor, wherein the separated product comprises diesel having high cetane number and fluid catalytic cracking gas oil.

In a more preferred embodiment, the fluid catalytic cracking gas oil is a fraction having an initial boiling point of not less than 330° C. and a hydrogen content of not less than 10.8 wt %.

In a more preferred embodiment, the fluid catalytic cracking gas oil is a fraction having an initial boiling point of not less than 350° C. and a hydrogen content of not less than 11.5 wt %.

The hydrocracking reaction system usually comprises a treating reactor and a cracking reactor, both of which are the fixed bed reactors. Other types of reactors may also be used.

The treating reactor and the cracking reactor are usually loaded with a hydrotreating catalyst and a hydrocracking catalyst, respectively.

The hydrotreating catalyst is a non-noble Group VIB or/and Group VIII metal catalyst supported on amorphous alumina or/and silicon-aluminium carrier, and the hydrocracking catalyst is a non-noble Group VIB or/and Group VIII metal catalyst supported on molecular sieves, wherein the non-noble Group VIB metal is molybdenum or/and tungsten; and the non-noble Group VIII metal is one or more selected from nickel, cobalt and iron. The molecular sieve for supporting hydrocracking catalyst is one or more selected from the group consisting of Y molecular sieves, β molecular sieve, ZSM-5 molecular sieve, SAPO series molecular sieves.

The hydrocracking is conducted under the conditions of a hydrogen partial pressure of from about 4.0 MPa to about 20.0 MPa, a reaction temperature of from about 280° C. to about 450° C., a volume hourly space velocity of about 0.1 to about 20 $h^{-1}$, and a hydrogen/oil ratio of from about 300 to about 2000 v/v. The hydrogen/oil ratio used herein means the ratio by volume of hydrogen to the fluid catalytic cracking gas oil.

In one aspect of the present invention, the present invention provides a catalytic conversion process for increasing the cetane barrel of diesel, wherein the feedstock oil is contacted with a catalytic cracking catalyst having a relatively homogeneous activity containing mainly the large pore zeolites in a catalytic conversion reactor, wherein the reaction temperature, oil vapors residence time and weight ratio of the catalyst/feedstock oil are sufficient to obtain a reaction product containing a diesel, and from about 12 to about 60% by weight of a fluid catalytic cracking gas oil relative to the weight of the feedstock oil; the reaction temperature ranges from about 420° C. to about 550° C.; the oil vapors residence time ranges from about 0.1 to about 5 seconds; the weight ratio of the catalytic cracking catalyst/feedstock oil is about 1-about 10; wherein all or a part of the fluid catalytic cracking gas oil is introduced into the hydrotreating unit for further treatment to obtain hydrogenated fluid catalytic cracking gas oil with high quality.

In a preferred embodiment, the hydrotreated fluid catalytic cracking gas oil can be introduced into the conventional catalytic cracking reactor or the riser with variable diameters to further produce a product comprising diesel and gasoline. In a preferred embodiment, the hydrogenated fluid catalytic cracking gas oil can be introduced back to the catalytic conversion reactor In a more preferred embodiment, the reaction temperature ranges from about 430° C. to about 500° C., preferably from about 430° C. to about 480° C.

In a more preferred embodiment, the oil vapors residence time ranges from about 0.5 to about 4 seconds, preferably from about 0.8 to about 3 seconds.

In a more preferred embodiment, the weight ratio of catalyst/feedstock oil is from about 2 to about 8, preferably from about 3 to about 6.

In a more preferred embodiment, the reaction pressure ranges from about 0.10 MPa to about 1.0 MPa, preferably from about 0.15 MPa to about 0.6 MPa.

In a more preferred embodiment, the hydrocracked tail oil of the fluid catalytic cracking gas oil is fed into a conventional catalytic cracking reactor and/or a riser with variable diameters, and/or the inventive catalytic conversion unit, and/or a hydrocracking unit, for further treatment.

In a more preferred embodiment, the feedstock oil is selected from or comprises petroleum hydrocarbons and/or other mineral oils, wherein petroleum hydrocarbons are selected from the group consisting of vacuum gas oil, atmospheric gas oil, coker gas oil, deasphalted oil, vacuum residue and atmospheric residue or mixture of two or more; other mineral oils are selected from the group consisting of coal liquefied oil, oil sand oil and shale oil, or mixture of two or more.

In a more preferred embodiment, the catalyst containing mainly the large pore zeolites comprises zeolites, inorganic oxides and clays respectively in an amount of from about 5 to about 50 wt %, preferably about 10 to about 30 wt % of the zeolites; from about 0.5 to about 50 wt % of the inorganic oxides; and from 0 to about 70 wt % of the clays, relative to the total weight of the catalyst on a dry basis, wherein the zeolite is used as the active component and is selected from large pore zeolites. Large pore zeolites are selected from one or more of rare earth Y, rare earth hydrogen Y, ultra-stable Y obtained by various methods, and high-silica Y.

The inorganic oxide as the substrate is selected from the group consisting of $SiO_2$ and/or $Al_2O_3$. On a dry basis, the inorganic oxide comprises about 50 to about 90 wt % of silica, and about 10 to about 50 wt % of alumina.

The clay as the binder is one or more selected from the group consisting of kaolin, meta halloysite, montmorillonite, diatomite, halloysite, saponite, rectorite, sepiolite, attapulgite, hydrotalcite, and bentonite.

The catalyst having a relatively homogeneous activity (including the catalytic cracking catalyst and the catalyst for producing more diesel) has an initial activity of not higher than about 80, preferably not higher than about 75, more preferably not higher than about 70, a self-balancing time ranging from about 0.1 h to about 50 h, preferably from about 0.2 h to about 30 h, more preferably from about 0.5 h to about 10 h, and an equilibrium activity ranging from about 35 to about 60, preferably from about 40 to about 55.

Said initial activity of the catalyst or the fresh catalyst activity as mentioned below means the catalyst activity evaluated by the light oil micro-reaction unit. It can be measured by the measuring method in the prior art: Enterprise standard RIPP 92-90-Micro-reaction activity test for catalytic cracking fresh catalysts, Petrochemical analytic method (RIPP test method), Yang Cuiding et al, 1990 (hereinafter referred to as RIPP 92-90). The initial activity of the catalyst is represented by light oil micro-reaction activity (MA), calculated by the formula MA=(output of the gasoline having a temperature less than 204° C. in the product+gas output+coke output)/total weight of the feedstock oil×100%=the yield of the gasoline having a temperature less than 204° C. in the product+gas yield+coke yield. The evaluation conditions of the light oil micro-reaction unit (by reference to RIPP 92-90) include pulverizing the catalyst into particles having a particle diameter of about 420-841 μm; the weight being 5 g; the reaction feedstocks being straightrun light diesel fuel having a distillation range of 235-337° C.; the reaction temperature being 460° C.; the weight hourly space velocity being 16 $h^{-1}$; and the catalyst/oil ratio being 3.2.

The self-balancing time of the catalyst is the time necessary for achieving the equilibrium activity by ageing at 800° C. and 100% water vapor (by reference to RIPP 92-90).

The catalyst having a relatively homogeneous activity is obtainable by, for example, the following three processing methods.

The Catalyst-Processing Method 1:

(1) loading a fresh catalyst into a fluidized bed, preferably a dense phase fluidized bed, contacting with water vapor, ageing under a certain hydrothermal circumstance to obtain a catalyst having a relatively homogeneous activity; and (2) loading the catalyst having a relatively homogeneous activity into the corresponding reaction unit.

The processing method 1 is specifically carried out, for example, as follows.

A fresh catalyst is loaded into a fluidized bed, preferably a dense phase fluidized bed, and water vapor is fed into the bottom of the fluidized bed. The fluidization of the catalyst is achieved under the action of water vapor, and the catalyst is aged by water vapor at the same time to obtain the catalyst having a relatively homogeneous activity. The ageing temperature ranges from about 400° C. to about 850° C., preferably from about 500° C. to about 750° C., more preferably from about 600° C. to about 700° C. The superficial linear velocity of the fluidized bed ranges from about 0.1 to about 0.6 m/s, preferably from about 0.15 to about 0.5 m/s. The ageing time ranges from about 1 h to about 720 h, preferably from about 5 h to about 360 h. According to the requirements on the industrial unit, the catalyst having a relatively homogeneous activity is loaded into the industrial unit, preferably into the regenerator of the industrial unit.

The Catalyst-Processing Method 2:

(1) loading a fresh catalyst into a fluidized bed, preferably a dense phase fluidized bed, contacting with an ageing medium containing water vapor, ageing under a certain hydrothermal circumstance to obtain a catalyst having a relatively homogeneous activity; and (2) loading the catalyst having a relatively homogeneous activity into the corresponding reaction unit.

The technical solution of the catalyst-processing method 2 is specifically carried out, for example, as follows.

A catalyst is loaded into a fluidized bed, preferably a dense phase fluidized bed, and an ageing medium containing water vapor is fed into the bottom of the fluidized bed. The fluidization of the catalyst is achieved under the action of the ageing medium containing water vapor, and the catalyst is aged by the ageing medium containing water vapor at the same time to obtain the catalyst having a relatively homogeneous activity. The ageing temperature ranges from about 400° C. to about 850° C., preferably from about 500° C. to about 750° C., more preferably from about 600° C. to about 700° C. The superficial linear velocity of the fluidized bed ranges from about 0.1 to about 0.6 m/s, preferably from about 0.15 to about 0.5 m/s. The weight ratio of water vapor to the ageing medium ranges from about 0.20 to about 0.9, preferably from about 0.40 to about 0.60. The ageing time ranges from about 1 h to about 720 h, preferably from about 5 h to about 360 h. According to the requirements on the industrial unit, the catalyst having a relatively homogeneous activity is loaded into the industrial unit, preferably into the regenerator of the industrial unit. The ageing medium comprises air, dry gas, regenerated flue gas, gas obtained by combusting air and dry gas or gas obtained by combusting air and burning oil, or other gases such as nitrogen gas. The weight ratio of water vapor to ageing medium ranges from about 0.2 to about 0.9, preferably from about 0.40 to about 0.60.

The Catalyst-Processing Method 3:

(1) loading a fresh catalyst into a fluidized bed, preferably a dense phase fluidized bed, feeding the hot regenerated catalyst in the regenerator into the fluidized bed, and conducting heat exchanging in the fluidized bed;

(2) contacting the heat exchanged fresh catalyst with water vapor or the ageing medium containing water vapor, ageing under a certain hydrothermal circumstance to obtain a catalyst having a relatively homogeneous activity; and (3) loading the catalyst having a relatively homogeneous activity into the corresponding reaction unit.

The technical solution of the present invention is specifically carried out, for example, as follows.

A fresh catalyst is loaded into a fluidized bed, preferably a dense phase fluidized bed, and the hot regenerated catalyst in the regenerator is loaded into the fluidized bed at the same time to conduct heat exchanging in the fluidized bed. Water vapor or an ageing medium containing water vapor is fed into the bottom of the fluidized bed. The fluidization of the fresh catalyst is achieved under the action of water vapor or the ageing medium containing water vapor, and the fresh catalyst is aged by water vapor or the ageing medium containing water vapor at the same time to obtain the catalyst having a relatively homogeneous activity. The ageing temperature ranges from about 400° C. to about 850° C., preferably from about 500° C. to about 750° C., more preferably from about 600° C. to about 700° C. The superficial linear velocity of the fluidized bed ranges from about 0.1 to about 0.6 m/s, preferably from about 0.15 to about 0.5 m/s. The ageing time ranges from about 1 h to about 720 h, preferably from about 5 h to about 360 h. Under the circumstance of the ageing medium containing water vapor, the weight ratio of water vapor to the ageing medium ranges from greater than about 0 to about 4, preferably ranges from about 0.5 to about 1.5. According to the requirements on the industrial unit, the catalyst having a relatively homogeneous activity is loaded into the industrial unit, preferably into the regenerator of the industrial unit. In addition, water vapor after the ageing step is fed into the reaction system (as one or more selected from the group consisting of stripping steam, anticoking steam, atomizing steam and lifting steam, and added into the stripper, settler, feedstock nozzle and prelifting zone of the catalytic cracking unit respectively) or the regeneration system. The ageing medium containing water vapor after the ageing step is fed into the regeneration system, and the heat exchanged regenerated catalyst is recycled back to the regenerator. The ageing medium comprises air, dry gas, regenerated flue gas, gas obtained by combusting air and dry gas or gas obtained by combusting air and burning oil, or other gases such as nitrogen gas.

By the aforesaid processing methods, the activity and selectivity distribution of the catalyst in the industrial reaction unit are more homogeneous; the selectivity of the catalyst is notably improved so as to decrease the dry gas and coke yields significantly.

The particle size distribution of the catalyst may be the particle size distribution of the conventional catalytic cracking catalyst or a coarse particle size distribution. In a more preferred embodiment, the catalyst is characterized in using the catalyst having a coarse particle size distribution.

The catalyst having a coarse particle size distribution comprise less than about 10 vol. %, preferably less than about 5 vol. % of the particles having a particle size of less than 40 μm relative to the volume of all the particles; less than about 15 vol. %, preferably less than about 10 vol. % of the particles having a particle size of greater than 80 μm relative to the volume of all the particles, and the remaining being the particles having a particle size of from 40 to 80 μm.

The details of the riser reactor with variable diameters into which the fluid catalytic cracking gas oil is introduced may be by reference to CN1237477A.

In a more preferred embodiment, the reactor is one or more selected from the group consisting of a riser, a fluidized bed with an equal linear velocity, a fluidized bed with an equal diameter, an upstream conveyor line and a downstream conveyor line or combinations thereof, or combinations of two or more same reactors, wherein the combinations comprises combinations in series or/and parallel; the riser is a conventional one with an equal diameter or various risers with variable diameters.

In a more preferred embodiment, the feedstock oil is fed into the reactor at one position, or at more than one positions at the same or different heights.

In a more preferred embodiment, the process further comprises separating the reaction product from the catalyst, stripping and coke-burning the spent catalyst and recycling it to the reactor, wherein the separated product comprises diesel having high cetane number and fluid catalytic cracking gas oil.

In a more preferred embodiment, the fluid catalytic cracking gas oil is a fraction having an initial boiling point of not less than 330° C. and a hydrogen content of not less than 10.8 wt %.

In a more preferred embodiment, the fluid catalytic cracking gas oil is a fraction having an initial boiling point of not less than 350° C. and a hydrogen content of not less than 11.5 wt %.

The reaction system for hydrotreating involves generally a fixed bed reactor, while other types of reactor may also be used.

The hydrotreating catalyst for the fluid catalytic cracking gas oil uses a metal of Group VIII/Group VIB of the periodic table of elements as the active component, and alumina and zeolite as support. Specifically, the hydrotreating catalyst comprises a support and molybdenum and/or tungsten and nickel and/or cobalt supported thereon. The hydrotreating catalyst comprises, in terms of oxides and based on the total weight of the catalyst, molybdenum and/or tungsten in an amount of about 10 to about 35 wt %, preferably about 18 to about 32 wt %; and nickel and/or cobalt in an amount of about 1 to about 15 wt %, preferably about 3 to about 12 wt %. The support consists of alumina and a zeolite in a weight ratio of the alumina to the zeolite ranging from about 90:10 to about 50:50, preferably from about 90:10 to about 60:40. The alumina is compounded by small pore alumina and large pore alumina i a weight ratio ranging from about 75:25 to about 50:50, wherein the small pore alumina comprises 95% or more by volume of pores with a diameter less than 80 angstroms based on the total volume of the pores, and the large pore alumina comprises 70% or more by volume of pores with a diameter of 60 to 600 angstroms based on the total volume of the pores. The zeolite is one or more selected from the group consisting of faujasite, mordenite, erionite, L-type zeolite, Ω zeolite, ZSM-4 zeolite and Beta zeolite, preferably Y-type zeolite, particularly preferably Y-type zeolite with a total acid amount ranging from about 0.02 to less than about 0.5 mmol/g, preferably from about 0.05 to about 0.2 mmol/g.

The hydrotreating is conducted under the processing conditions of a hydrogen partial pressure of from about 3.0 MPa to about 20.0 MPa, a reaction temperature of from about 280 MPa to about 450° C., a volume hourly space velocity of about 0.1 to about 20 $h^{-1}$, and a hydrogen/oil ratio of from about 300 to about 2000 v/v. The hydrogen/oil ratio used herein each means the ratio by volume of the hydrogen to the fluid catalytic cracking gas oil.

The hydrotreating catalyst for the fluid catalytic cracking gas oil is prepared by a process comprising:

Mixing and shaping a precursor of alumina and a zeolite, calcinating, immersing with an aqueous solution containing nickel and/or cobalt and molybdenum and/or tungsten, then drying and calcinating. The precursor of the alumina is a mixture of the precursor of small pore alumina comprising 95% or more by volume of pores with a diameter less than 80 angstroms based on the total volume of the pores, and the precursor of large pore alumina comprising 70% or more by volume of pores with a diameter of 60 to 600 angstroms based on the total volume of the pores. The amounts of the precursor of the small pore alumina, of the precursor of the large pore alumina and of the zeolite are selected such that a weight ratio of the small pore alumina to the large pore alumina ranging from about 75:25 to about 50:50, a weight ratio of the total weight of the alumina to the zeolite ranging from about 90:10 to about 50:50, preferably from about 90:10 to about 60:40. The precursor of the small pore alumina is a hydrated alumina comprising greater than about 60 wt % of monohydrated alumina, and precursor of the large pore alumina is a hydrated alumina comprising greater than about 50 wt % of monohydrated alumina.

The inventive technical solutions combine the catalytic cracking, hydrotreating and hydrocracking, so as to achieve the maximum production of diesel having high cetane number from heavy feedstocks having a lower hydrogen content.

The present invention has the following technical advantages as compared with the prior art:

1. The alkanes, alkyl aromatics side chains and so on in the feedstocks are selectively cracked into the diesel fraction of the product with maximum production through optimum control to the processing parameters and catalyst properties, so as to ensure the main components in the diesel fraction are alkanes, such that a diesel having high cetane number can be produced by catalytic conversion;
2. The hydrocarbons with various properties are selectively reacted under the respectively suitable reaction conditions, the selectivity of dry gas and coke is improved, and the catalyst with a coarse particle size distribution can further improve the selectivity of dry gas and coke;
3. The heavy oil is catalytically converted by the inventive process, such that the fluid catalytic cracking gas oil comprises mainly the aromatics components, whose properties change relatively less with the properties of the feedstocks, such that the feed to the hydrotreating and/or hydrocracking units is stable, and the operation cycle is correspondingly elongated;
4. Since the particles are more homogeneous, the local temperature distribution of the catalyst during the regeneration becomes more homogeneous, and the fracture tendency of the catalyst is also correspondingly decreased;
5. The catalyst consumption is reduced, and the catalyst content entrained in the fluid catalytic cracking gas oil is decreased.

Unless otherwise defined, all technical and scientific terms used herein have the same meaning as commonly understood by one of ordinary skill in the art to which the present invention belongs. Although methods and materials similar or equivalent to those described herein can be used in the practice or testing of the present invention, suitable methods and materials are described below. In case of conflict, the patent specification, including definitions, will control. In addition, the materials, methods, and examples are illustrative only and not intended to be limiting.

As used herein, the term "comprising" means that other steps and ingredients that do not affect the final result can be added. This term encompasses the terms "consisting of" and "consisting essentially of".

The term "method" or "process" refers to manners, means, techniques and procedures for accomplishing a given task including, but not limited to, those manners, means, techniques and procedures either known to, or readily developed from known manners, means, techniques and procedures by practitioners of the chemical and chemical engineering.

Throughout this disclosure, various aspects of the present invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "between" a first indicate number and a second indicate number and "ranging/ranges from" a first indicate number "to" a second indicate number are used herein interchangeably and are meant to include the first and second indicated numbers and all the fractional and integral numerals therebetween.

BRIEF DESCRIPTION OF THE DRAWINGS

The present invention is herein described, by way of example only, with reference to the accompanying drawings. With specific reference now to the drawings in detail, it is stressed that the particulars shown are by way of example and for purposes of illustrative description of the preferred embodiments of the present invention only, and are presented in the cause of providing what is believed to be the most useful and readily understood description of the principles and conceptual aspects of the present invention. In this regard, no attempt is made to show structural details of the present invention in more detail than is necessary for a fundamental understanding of the invention, the description taken with the drawings making apparent to those skilled in the art how the several forms of the invention may be embodied in practice.

DETAILED DESCRIPTION OF THE SCHEMATIC FLOW CHART

The drawings are intended to be illustrative, not limitative, for the processes provided in the present invention.

Figure 1:
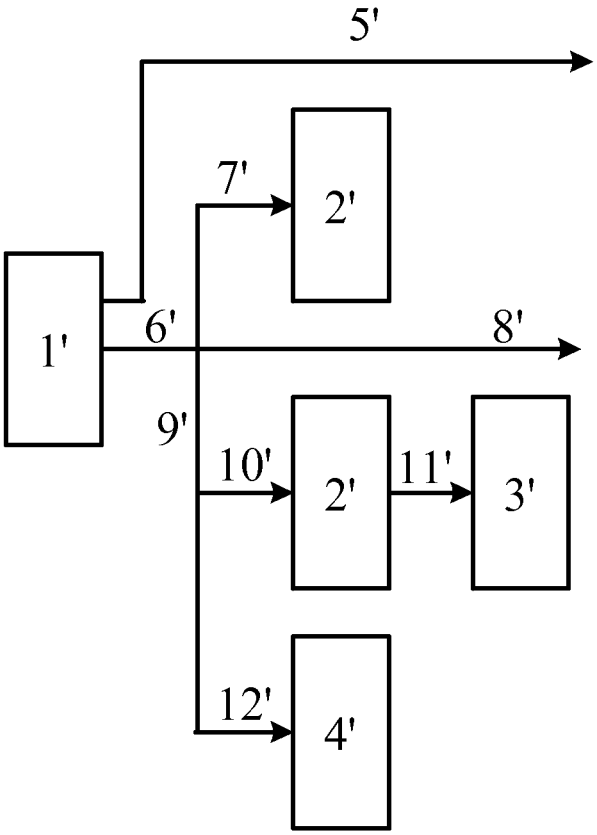
FIG. 1 is the schematic flow chart of one embodiment of the present invention.

FIG. 1 is the schematic flow chart of one embodiment of the present invention.

The schematic flow chart is stated as follows:

As showed in FIG. 1, the feedstock oil is introduced into a catalytic cracking reactor 1' to obtain the components of catalytic diesel, fluid catalytic cracking gas oil and so on, wherein the catalytic diesel is drawn out via line 5', and all or a part of the fluid catalytic cracking gas oil is drawn out via line 6' and line 8'.

Or/and, all or a part of the fluid catalytic cracking gas oil is introduced into a conventional catalytic cracking reactor or a riser with variable diameters 2' via lines 6' and 7', for the production of diesel, gasoline and other products.

Or/and, all or a part of the fluid catalytic cracking gas oil is introduced into a hydrotreating unit 2' via lines 6', 9' and 10', and the hydrotreated fluid catalytic cracking gas oil is introduced into a conventional catalytic cracking reactor or a riser with variable diameters 3' via line 11', for the production of diesel, gasoline and other products.

Or/and, all or a part of the fluid catalytic cracking gas oil is introduced into a hydrocracking unit 4' via lines 6', 9' and 12', and the hydrocracked tail oil of the fluid catalytic cracking gas oil can be drawn out for introduction into reactors such as a conventional catalytic cracking reactor, a riser with variable diameters and the inventive unit, for the production of diesel, gasoline and other products.

DETAILED DESCRIPTION OF THE EMBODIMENTS

The drawings are intended to be illustrative, not limitative, for the processes provided in the present invention.

The technological process is stated as follows.

Figure 2:
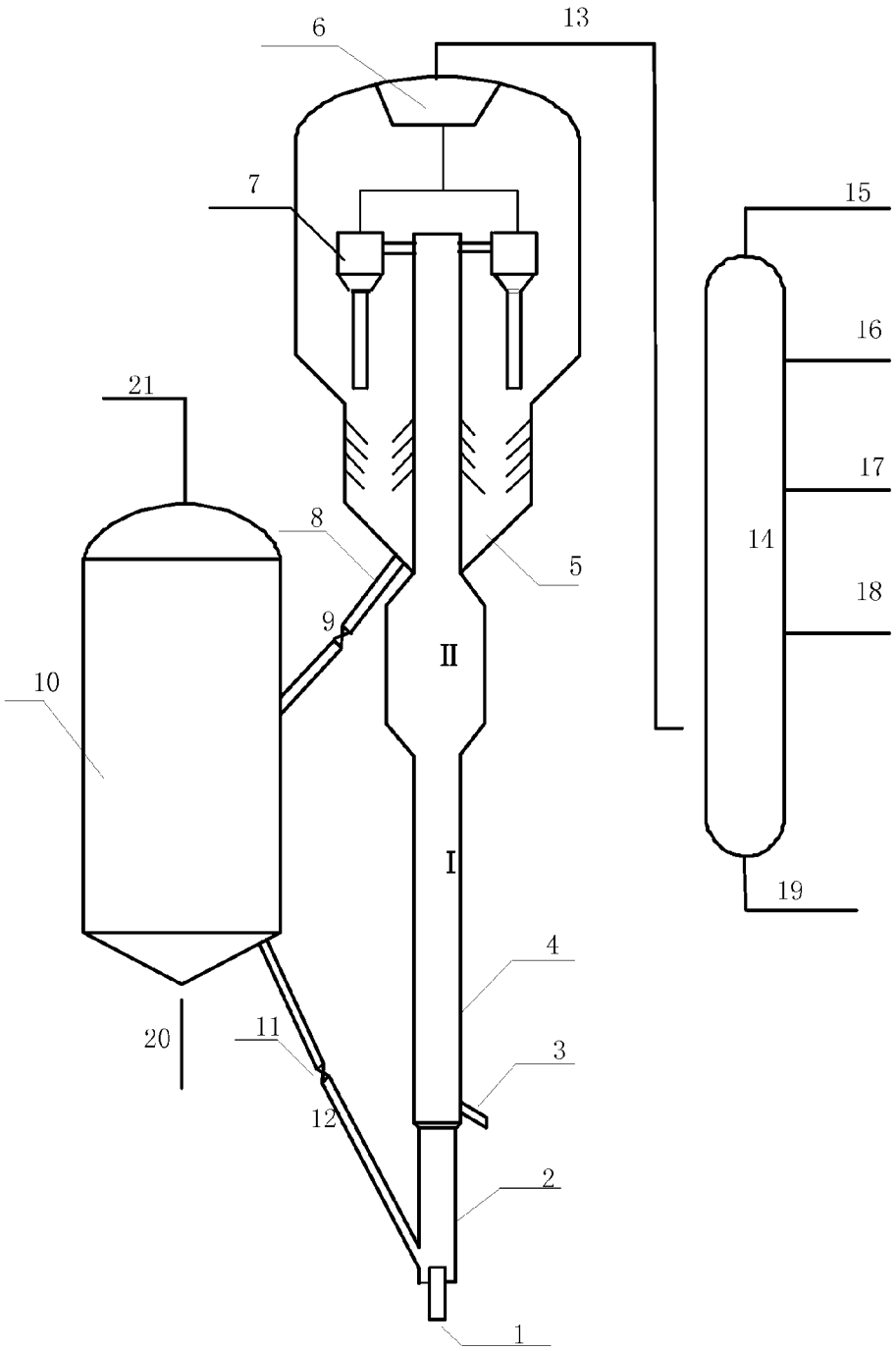
FIG. 2 is the schematic figure of one embodiment of the present invention.

As showed in FIG. 2, the regenerated catalyst enters the prelifting section 2 at the bottom of the riser 4 via the regeneration standpipe 12 and slide valve 11. The prelifting medium also enters the prelifting section 2 via line 1. Under the action of the prelifting medium, the regenerated catalyst enters the reaction zone I at the lower part of the riser 4 through the prelifting section 2. The catalytic feedstock oil also enters the reaction zone I at the lower part of the riser 4 via line 3, contact and react with the catalyst, and flow upward to the reaction zone II. The oil/catalyst mixture after reaction enters the cyclone separator 7 from the outlet of riser, and is subjected to the gas-solid separation by the cyclone separator 7. The oil vapors after separation enters the reactor vessel collection chamber 6. The spent catalyst separated with the oil vapors flows downward to the stripping section 5, and is stripped therein with superheated steam. The stripped spent catalyst enters the regenerator 10 via the spent catalyst standpipe 8 and slide valve 9 for regeneration. The main air enters the regenerator 10 via line 20. Coke on the spent catalyst is burned off to regenerate the inactivated spent catalyst, and the flue gas enters the exhauster via pipeline 21. The regenerated catalyst is fed back to the lifting section 2 via the standpipe 12 and slide valve 11 for recycling use.

The oil vapors in the collector chamber 6 is fed into the subsequent separation system 14 via the main oil vapors pipe line 13. The dry gas, liquefied gas, gasoline, diesel and fluid catalytic cracking gas oil obtained after separation are drawn out respectively via lines 15, 16, 17, 18 and 19.

All or a part of the fluid catalytic cracking gas oil from line 19 can be discharged out directly; or/and be introduced into a conventional catalytic cracking reactor or a riser with variable diameters; or/and be introduced into a hydrotreating unit to obtain a hydrotreated fluid catalytic cracking gas oil, which is fed into a riser; or/and be introduced into a hydrocracking reactor. The fluid catalytic cracking gas oil is thus further treated to obtain the target product.

The following examples are used to demonstrate the effect of the present invention and are not meant to limit the scope of the invention to the detailed examples shown herein.

The feedstock oil used in the examples is vacuum gas oil (VGO-D) and atmospheric residue (AR), and the properties thereof are listed in Table 1.

The catalyst zeolite used in the inventive Examples was the aged high silica zeolite. Said high silica zeolite was prepared by the following steps: using NaY to conduct $SiCl_4$ vapor phase treatment and rare earth ion exchanging to obtain a sample having a silica:alumina ratio of 18 and a rare earth content of 2 wt % (calculated in terms of $RE_2O_3$), aging such sample at 800° C. and 100% steam. 969 g of halloysite (produced by China Kaolin Clay Company, and having a solid content of 73%) were slurried by using 4,300 g of decationic water. Then 781 g of pseudo-boehmite (produced by Shandong Zibo Boehmite Factory, and having a solid content of 64%) and 144 ml of hydrochloric acid (having a concentration of 30%, and a specific gravity of 1.56) were added therein, homogeneously stirred and stood for aging at 60° C. for 1 h. The pH thereof was maintained to be 2-4, and the temperature thereof was decreased to room temperature. Then the pre-prepared zeolite slurry containing 800 g of high silica zeolites (dry basis) and 2,000 g of chemical water were added therein, homogeneously stirred, and dried by spraying to obtain the catalyst after free $Na^+$ was washed off (having a fresh catalyst activity of 79, a self-balancing time of 10 h under the conditions of 800° C. and 100% steam, and an equilibrium activity of 55). The catalyst obtained was aged at 800° C. and 100% steam. The aged catalyst was nominated as A. A part of the ageing agent was elutriated to remove fine particles and particles having a particle size of greater than 100 μm, so as to obtain the catalyst having a coarse particle size distribution, nominated as B. The properties of the catalysts were listed in Table 2.

The hydrotreating catalyst and hydrocracking catalyst used in the examples respectively have the commodity numbers of RN-2 and RT-1 and both are produced by Changling catalyst factory of SINOPEC Catalyst Company.

Inventive Example 1

The example illustrated the case using the inventive process for producing high quality light diesel and fluid catalytic cracking gas oil through a selective cracking reaction.

The flow chart of a pilot scale catalytic cracking unit was as shown in FIG. 2. The feedstock oil VGO-D was injected into the riser reactor via line 3, contacted and reacted with the steam-lifted catalyst B at the lower part of the riser reactor. The weight ratio of the catalyst B to the feedstock oil in the riser reactor was 4:1. The residence time of the feedstock oil in the riser reactor was 1.6 seconds. The reaction temperature was 460° C. The pressure in the collection chamber was 0.15 MPa. The oil vapors from the riser was fed into the downstream fractionation system after the separation by a cyclone separator. The spent catalyst which has coke was introduced into the stripping section. The stripped spent catalyst was regenerated in the regenerator, and the regenerated catalyst was fed back to the riser reactor for recycling use. The conditions and results of experiments were listed in table 3, and the properties of the diesel were listed in table 4.

Comparative Example

The experiment was conducted using a riser reactor same as the one used in the above example. The feedstock oil, the experiment steps and methods were the same as those of inventive example 1 above, except that the catalyst used was changed from catalyst B used in the above example to catalyst A. The operation conditions and distribution of products were listed in table 3. The results of the experiments were listed in table 3, the properties of the diesel were listed in table 4, and the properties of the fluid catalytic cracking gas oil were listed in table 5.

It could be seen from table 3 that the yields of dry gas and coke of the inventive example were significantly lower than those of the comparative example. It could be seen from table 4 that the diesel properties of the inventive example were slightly better than those of the comparative example, with cetane numbers of 53 versus 52.

TABLE 1

| Type of the Feedstock Oil | VGO-D | AR |
|---|---|---|
| Density (20° C.), g/cm$^3$ | 0.8653 | 0.9029 |
| Carbon Residue, wt % | 0.15 | 4.0 |
| Total Nitrogen Content, wt % | 0.04 | 0.26 |
| Sulfur, wt % | 0.09 | 0.13 |
| C, wt % | 86.12 | 86.86 |
| H, wt % | 13.47 | 12.86 |
| Heavy Metal Content, ppm | | |
| Ni | 0.12 | 5.3 |
| V | <0.1 | 1.1 |
| Distillation Range, ° C. | | |
| Initial Boiling Point | 284 | 308 |
| 10% | 342 | 395 |
| 30% | 390 | 440 |
| 50% | 420 | 479 |
| 70% | 449 | 550 |
| 90% | 497 | / |

TABLE 2

| | Number of Examples | |
|---|---|---|
| | A | B |
| | Type of the Particle Size | |
| | Conventional Particle Size | Coarse Particle Size |
| Chemical Composition, wt % | | |
| $Al_2O_3$ | 25 | 25 |
| $Na_2O$ | | |
| Superficial Density, kg/m$^3$ | 790 | 778 |
| Pore Volume, ml/g | | |
| Specific Surface area, m$^2$/g | 156 | 141 |
| Abrasion Index, wt % hour$^{-1}$ | 1.0 | 1.0 |
| Sieved Composition, wt % | | |
| 0~40 microns | 12 | 8 |
| 40~80 microns | 65 | 78 |
| >80 microns | 23 | 14 |

TABLE 3

| Number of Examples | Inventive Example 1 B | Comparative Example 1 A |
|---|---|---|
| Reaction Temperature, ° C. | 460 | 460 |
| Reaction Time, second | 1.6 | 1.6 |
| Catalyst/oil Ratio | 4 | 4 |
| Water Injected (based on the feed), % | 10 | 10 |
| Distribution of the Products, wt % | | |
| Dry Gas | 0.48 | 0.57 |
| Liquefied Petroleum Gas | 7.01 | 7.03 |
| Gasoline | 20.76 | 20.91 |
| Diesel | 29.76 | 29.46 |
| Fluid Catalytic Cracking Gas Oil | 39.83 | 39.67 |
| Coke | 1.78 | 1.98 |
| Loss | 0.38 | 0.38 |

TABLE 4

| | Inventive Example 1 | Comparative Example 1 |
|---|---|---|
| Properties of Diesel | | |
| Density, g/cm$^3$ | 0.8457 | 0.8463 |
| Refraction index | 1.4771 | 1.4775 |
| Solidifying Point, ° C. | 12 | 12 |
| Distillation Range, ° C. | | |
| Initial Boiling Point | 210 | 211 |
| 5% | 242 | 244 |
| 10% | 245 | 246 |
| 30% | 282 | 282 |
| 50% | 308 | 308 |
| 70% | 332 | 331 |
| 90% | 352 | 350 |
| Final Boiling Point | / | / |
| Composition, % | | |
| Paraffins | 47.1 | 45.9 |
| Cycloalkanes | 27.9 | 28 |
| Aromatics | 25.0 | 26.1 |
| Cetane Number | 53 | 52 |
| Cetane Number Barrel of Diesel* | 1577.28 | 1531.92 |

*Cetane Number Barrel of Diesel = Cetane Number of Diesel × Yield of Diesel

TABLE 5

| | Inventive Example 1 | Comparative Example 1 |
|---|---|---|
| Properties of Fluid Catalytic Cracking Gas Oil | | |
| Density, g/cm$^3$ | 0.8517 | 0.8522 |
| Refraction index | 1.4561 | 1.4565 |
| Solidifying Point, ° C. | 42 | 42 |
| Distillation Range, ° C. | | |
| Initial Boiling Point | 300 | 301 |
| 5% | 374 | / |
| 10% | 384 | 387 |
| 30% | 400 | / |
| 50% | 416 | 417 |
| 70% | 437 | |
| 90% | 466 | 464 |
| Final Boiling Point | / | / |
| Elemental Composition, % | | |
| C | 86.07 | 86.08 |
| H | 13.76 | 13.75 |

Example 2

The example illustrated the case using the inventive process for producing high quality light diesel and lower olefin gasoline through a selective cracking reaction.

The flow chart of a pilot scale catalytic cracking unit was as shown in FIG. 2. The feedstock oil VGO-D was injected into the riser reactor via line 3, contacted and reacted with the steam-lifted catalyst B at the lower part of the riser reactor. The weight ratio of the catalyst B to the feedstock oil in the riser reactor was 4:1. The residence time of the feedstock oil in the riser reactor was 1.6 seconds. The reaction temperature was 460° C. The pressure in the collection chamber was 0.15 MPa. The oil vapors withdrawn from the riser was fed into the downstream fractionation system after the separation by a cyclone separator, so as to obtain the target products of diesel, fluid catalytic cracking gas oil and so on by separation. The spent catalyst which has coke was introduced into the stripping section. The stripped spent catalyst was regenerated in the regenerator, and the regenerated catalyst was fed back to the riser reactor for recycling use.

The fluid catalytic cracking gas oil obtained was fed directly into a riser reactor with variable diameters for catalytic conversion. The same catalyst B was used, and the weight ratio of the catalyst B to the fluid catalytic cracking gas oil in the riser reactor with variable diameters was 6:1. The residence time of the fluid catalytic cracking gas oil in the riser reactor was 5.5 seconds. The temperature of the first reaction zone (abbreviated as zone I) was 510° C., while the temperature of the second reaction zone (abbreviated as zone II) was 490° C. The oil vapors from the riser with variable diameters were fed into the downstream fractionation system after the separation by a cyclone separator, so as to obtain the target products of diesel, gasoline and so on by separation. The conditions and results of experiments were listed in table 6, the properties of the diesel were comparable to those of inventive example 1, and the properties of the gasoline were listed in table 7.

It could be seen from table 6 that, in this example, the yield of the dry gas was only 0.96%, the yield of the coke was only 2.78%, the yield of the heavy oil was only 2.24%, while the yield of the total liquid (the yield of liquefied petroleum gas+the yield of gasoline+the yield of light diesel+the yield of light cycle oil) was as high as 93.63%. It could be seen from tables 4 and 7 that while the high quality diesel was produced, the gasoline product with low olefin content was produced.

TABLE 6

| Example 2 | |
|---|---|
| Catalytic Cracking Unit | |
| Reaction Temperature, ° C. | 460 |
| Reaction Time, second | 1.6 |
| Catalyst/oil Ratio | 4 |
| Water Injected (based on the feed), % | 10 |
| Catalytic Cracking Unit for Producing More Lower Olefins Gasoline | |
| Temperature of zone I, ° C. | 510 |
| Temperature of zone II, ° C. | 490 |
| Reaction Time, second | 5.5 |
| Catalyst/oil Ratio | 6 |
| Water Injected (based on the feed), % | 5 |
| Distribution of the Products, wt % | |
| Dry Gas | 0.96 |
| Liquefied Gas | 18.03 |
| Gasoline | 39.79 |
| Light Diesel | 29.76 |
| Light Cycle Oil | 6.05 |
| Heavy Oil | 2.24 |
| Coke | 2.78 |
| Loss | 0.39 |

TABLE 7

| Example 2 | |
|---|---|
| Property of Gasoline | Gasoline |
| Density, g/cm$^3$ | 0.7358 |
| Refraction index | 1.4174 |
| Induction Period, min | >500 |
| Distillation Range, ° C. | |
| Initial Boiling Point | 43 |
| 5% | 61 |
| 10% | 67 |

TABLE 7-continued

| Example 2 | |
|---|---|
| Property of Gasoline | Gasoline |
| 30% | 86 |
| 50% | 108 |
| 70% | 134 |
| 90% | 166 |
| Final Boiling Point | 194 |
| Composition, % | |
| Saturated Hydrocarbons | 49.0 |
| Olefins | 34.9 |
| Aromatics | 16.1 |
| RON | 89.0 |

Example 3

The example illustrated the case using the inventive process for producing high quality light diesel through a selective cracking reaction by the combined process of catalytic cracking and hydrocracking.

The flow chart of a pilot scale catalytic cracking unit was as shown in FIG. 2. The feedstock oil (VGO-D) was injected into the riser reactor via line 3, contacted and reacted with the steam-lifted catalyst B at the lower part of the riser reactor. The weight ratio of the catalyst B to the feedstock oil in the riser reactor was 4:1. The residence time of the feedstock oil in the riser reactor was 1.6 seconds. The reaction temperature was 460° C. The pressure in the collection chamber was 0.15 MPa. The oil vapors from the riser was fed into the downstream fractionation system after the separation by a cyclone separator, so as to obtain the target products of diesel and fluid catalytic cracking gas oil by separation. The spent catalyst which has coke was introduced into the stripping section. The stripped spent catalyst was regenerated in the regenerator, and the regenerated catalyst was fed back to the riser reactor for recycling use. The fluid catalytic cracking gas oil was fed into the downstream hydrocracking unit. The reaction conditions for the hydrocracking were: a treating reaction temperature of 370° C., a cracking reaction temperature of 380° C., a hydrogen partial pressure of 12.0 MPa, a volume hourly space velocity of 1.2 $h^{-1}$. The conditions and results of tests were listed in table 8, the properties of the catalytic diesel were comparable to the light diesel of inventive example 1, the properties of the hydrocracked diesel were listed in table 9, and the properties of the hydrocracked tail oil were listed in table 10.

It could be seen from table 8 that, for this example, the yield of the catalytic diesel was as high as 29.76 wt %, the yield of the hydrocracked diesel was as high as 18.63 wt %, the yield of the dry gas was only 0.48 wt %, the yield of the coke was only 1.78 wt %. It could be seen from tables 4 and 9 that the cetane number of the catalytic diesel produced by the example was as high as 53, the cetane number of the hydrocracked diesel produced by the example was as high as 68.2, the cetane barrel of the diesel was as high as 2847.846 (i.e., 29.76×53+18.63×68.2), and the BMCI value of the hydrocracked tail oil as by-product reached to 15.6, which was useful as the raw material with relatively advantageous properties for reactors such as catalytic cracking.

TABLE 8

| Example 3 | |
|---|---|
| Catalytic Cracking Unit | |
| Reaction Temperature, ° C. | 460 |
| Reaction Time, second | 1.6 |
| Catalyst/oil Ratio | 4 |
| Water Injected (based on the feed), % | 10 |
| Hydrocracking Unit | |
| Treating Reaction Temperature, ° C. | 370 |
| Cracking Reaction Temperature, ° C. | 380 |
| Partial Pressure of Hydrogen, MPa | 12.0 |
| Volume Hourly Space Velocity, $h^{-1}$ | 1.2 |
| Distribution of the Products, wt % | |
| Dry Gas | 0.48 |
| Liquefied Gas | 7.01 |
| Gasoline | 20.76 |
| Naphtha | 15.93 |
| Catalytic Diesel | 29.76 |
| Hydrocracked Diesel | 18.62 |
| Hydrocracked Tail Oil | 6.77 |
| Coke | 1.78 |
| Loss | 0.38 |
| Total | 101.49 |

TABLE 9

| Example 3 | | |
|---|---|---|
| Properties of Product | Hydrocracked Diesel | Hydrocracked Tail Oil |
| Density, g/cm$^3$ | 0.8153 | 0.8430 |
| Refraction index | 1.4525 | 1.4481 |
| Solidifying Point, ° C. | −28 | 20 |
| Distillation Range, ° C. | | |
| Initial Boiling Point | 233 | 295 |
| 5% | 244 | 378 |
| 10% | 252 | 385 |
| 30% | 269 | 397 |
| 50% | 282 | 409 |
| 70% | 304 | 422 |
| 90% | 327 | 449 |
| Final Boiling Point | 344 | 512 |
| Composition, % | | |
| Paraffin | / | 53.3 |
| Cycloalkane | / | 45.0 |
| Aromatics | / | 1.7 |
| Cetane Number | 68.2 | |
| BMCI | | 15.6 |

Example 4

The example illustrated the case using the inventive process for producing high quality light diesel through a selective cracking reaction by the combined process of catalytic cracking and hydrotreating.

The flow chart of a pilot scale catalytic cracking unit was as shown in FIG. 2. The atmospheric residue (AR) was injected into the riser reactor via line 3, contacted and reacted with the steam-lifted catalyst A at the lower part of the riser reactor. The weight ratio of the catalyst B to the feedstock oil in the riser reactor was 3:1. The residence time of the feedstock oil in the riser reactor was 1.6 seconds. The reaction temperature was 450° C. The pressure in the collection chamber was 0.2 MPa. The vapors from the riser was fed into the downstream fractionation system after the separation by a cyclone separator, so as to obtain the target products of diesel, fluid catalytic cracking gas oil and so on by separation. The spent catalyst which has coke was introduced into the stripping section. The stripped spent catalyst was regenerated in the regenerator, and the regenerated catalyst was fed back to the riser reactor for recycling use. The fluid catalytic cracking gas oil was fed into the downstream hydrotreating unit. The reaction conditions for the hydrogenation were: a hydrogen partial pressure of 14 MPa, a reaction temperature of 385° C., and a volume hourly space velocity of 0.235 $h^{-1}$. The hydrotreating fluid catalytic cracking gas oil from the unit was fed back to the catalytic cracking unit. The conditions and results of tests were listed in table 10, and the properties of the diesel were listed in table 11.

It could be seen from table 10 that, for this example, the yield of the diesel was as high as 46.51 wt %; and it could be seen from table 11 that, for this example, the cetane number of the diesel was as high as 52.5, and the cetane barrel of the diesel was as high as 2441.78.

Example 5

The experiment was conducted using a riser reactor same as the one used in the above example 4. The feedstock oil, the test steps and methods were the same as those of inventive example 1 above, except that the catalyst used was changed from catalyst B having a coarse particle size used in the example 4 to catalyst A having a conventional particle size. The conditions and results of the tests were listed in table 10, and the properties of the diesel were listed in table 11.

It could be seen from table 10 that, for the example, the yield of the diesel was as high as 45.88 wt %; and it could be seen from table 11 that, for the example, the cetane number of the diesel was as high as 51.4, and the cetane barrel of the diesel was as high as 2358.23.

It could also be seen from table 10 that the yields of the dry gas and coke in example 5 are significantly higher than those in example 4, which shows the catalyst B having a coarse particle size could reduce more the yields of the dry gas and coke compared with the catalyst A having a conventional particle size.

TABLE 10

| Number of Examples | Example 4 B | Example 5 A |
|---|---|---|
| Reaction Temperature, ° C. | 450 | 450 |
| Reaction Time, second | 1.6 | 1.6 |
| Catalyst/oil Ratio | 3 | 3 |
| Water/oil Ratio | 0.05 | 0.05 |
| Distribution of the Products*, wt % | | |
| Dry Gas | 1.52 | 1.72 |
| Liquefied Gas | 13.95 | 13.98 |
| Gasoline | 33.50 | 33.75 |
| Diesel | 46.51 | 45.88 |
| Heavy Oil | 0.00 | 0.00 |
| Coke | 4.12 | 4.27 |
| Loss | 0.40 | 0.40 |

*Calculated based on the total weight of atmospheric residue and hydrogen

TABLE 11

| | Example 4 | Example 5 |
|---|---|---|
| Properties of the Diesel | | |
| Density, g/cm³ | 0.8461 | 0.8468 |
| Refraction index | 1.4782 | 1.4785 |
| Solidifying Point, ° C. | 12 | 12 |

TABLE 11-continued

| | Example 4 | Example 5 |
|---|---|---|
| Distillation Range, ° C. | | |
| Initial Boiling Point | 200 | 201 |
| 5% | 240 | 243 |
| 10% | 245 | 247 |
| 30% | 275 | 275 |
| 50% | 300 | 301 |
| 70% | 335 | 336 |
| 90% | 348 | 350 |
| Cetane Number | 52.5 | 51.4 |
| Cetane Number Barrel of Diesel* | 2441.78 | 2358.23 |

*Cetane Number Barrel of Diesel = Cetane Number of Diesel × Yield of Diesel

It is appreciated that certain aspects and characteristics of the invention, which are, for clarity, described in the context of separate embodiments, may also be provided in combination in a single embodiment. Conversely, various aspects and characteristics of the invention, which are, for brevity, described in the context of a single embodiment, may also be provided separately or in any suitable sub-combination.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

While the invention has been described in conjunction with specific embodiments and examples thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. A catalytic conversion process for producing diesel, comprising:

loading a catalyst into a catalytic conversion reactor, wherein the catalyst comprises an aged catalyst having a reduced activity;

contacting a feedstock oil with the catalyst in the catalytic conversion reactor to produce oil vapors;

separating the oil vapors to obtain diesel and fluid catalytic cracking gas oil, wherein a weight of the fluid catalytic cracking gas oil relative to a weight of the feedstock oil ranges from 12% to 60%, a reaction temperature ranges from about 420° C. to about 550° C., a residence time of the oil vapors ranges from about 0.1 second to about 5 seconds, a weight ratio of the catalyst to the feedstock oil ranges from about 1 to about 10, wherein less than about 10 vol.% of the catalyst has a particle size of less than 40 μm, less than about 15 vol.% of the catalyst has a particle size of greater than 80 μm, and the remainder of the catalyst has a particle size of from about 40 μm to about 80 μm, wherein the volume percentage is calculated based on a total volume of the catalyst.

2. The process according to claim 1, further comprising introducing all or a part of the fluid catalytic cracking gas oil into a reactor chosen from a conventional catalytic cracking reactor, a variable diameter riser, the catalytic conversion reactor of claim 1, or a second catalytic conversion reactor.

3. The process according to claim 1, further comprising introducing all or a part of the fluid catalytic cracking gas oil into a hydrocracking unit.

4. The process according to claim 1, further comprising introducing all or a part of the fluid catalytic cracking gas oil into a hydrotreating unit.

5. The process according to claim 3, further comprising introducing a hydrocracked tail oil from the hydrocracking unit into a conventional catalytic cracking reactor or a variable diameter riser.

6. The process according to claim 4, further comprising introducing all or a part of the hydrotreated fluid catalytic cracking gas oil from the hydrotreating unit into a reactor chosen from a conventional catalytic cracking reactor, a variable diameter riser, or the catalytic conversion reactor of claim 1.

7. The process according to claim 1, wherein the feedstock oil is selected from or comprises petroleum hydrocarbons and/or other mineral oils, wherein petroleum hydrocarbons are selected from the group consisting of vacuum gas oil, atmospheric gas oil, coker gas oil, deasphalted oil, vacuum residue, atmospheric residue, and combinations thereof, wherein other mineral oils are selected from the group consisting of coal liquefied oil, oil sand oil, shale oil, and combinations thereof.

8. The process according to claim 1, wherein the catalyst comprises from about 5 wt % to about 35 wt % of zeolites, from about 0.5 wt % to about 50 wt % of inorganic oxides, and from 0 wt % to about 70 wt % of clays, calculated based on a total weight of the catalyst on a dry basis, wherein the zeolites are large pore zeolites selected from the group consisting of rare earth Y, rare earth H-Y, ultra-stable Y, high-silica Y, and combinations thereof.

9. The process according to claim 8, wherein the catalyst comprises from about 10 to about 30 wt % of the of zeolites.

10. The process according to claim 1, wherein the catalytic conversion reactor is one or more selected from the group consisting of a riser, a fluidized bed with a uniform superficial fluid velocity, a fluidized bed with a uniform diameter, an upstream conveyor line and a downstream conveyor line or combinations thereof, and two or more reactors of a same type connected in series or in parallel.

11. The process according to claim 1, wherein the feedstock oil is introduced into the catalytic conversion reactor at one or more locations.

12. The process according to claim 1, wherein the temperature of the catalytic conversion ranges from about 430° C. to about 500° C., the residence time of the oil vapors ranges from about 0.5 second to about 4 seconds, the weight ratio of the catalyst to the feedstock oil is from about 2 to about 8, and the reaction pressure ranges from about 0.10 MPa to about 1.0 MPa.

13. The process according to claim 1, wherein the fluid catalytic cracking gas oil is a fraction having an initial boiling point of not less than 350° C. and a hydrogen content of not less than 11.5 wt %.

14. The process according to claim 1, wherein the catalyst a self-balancing time ranging from about 0.1 h to about 50 h, and an equilibrium activity ranging from about 35 to about 60 wherein the initial activity, the equilibrium activity, and the self-balancing time are measured according to Enterprise Standard RIPP 92-90.

15. The process according to claim 1, further comprising contacting a fresh catalyst with an aging medium in a fluidized bed for about 1 h to about 720 h to obtain the aged catalyst, wherein a temperature of the fluidized bed ranges from about 400° C. to about 850° C., a superficial linear velocity of the fluidized bed ranges from about 0.1 m/s to about 0.6 m/s.

16. The process according to claim 15, wherein the aging medium comprises steam.

17. The process according to claim 15, wherein the fresh catalyst is heated by a hot regenerated catalyst from a regenerator.

18. The process according to claim 4, wherein the hydrotreating unit has a hydrogen partial pressure of from about 3.0 MPa to about 20.0 MPa, a reaction temperature of from about 300° C. to about 450° C., a volume hourly space velocity of about 0.1 $h^{-1}$ to about 3 $h^{-1}$, and a hydrogen-to-oil ratio of from about 300 v/v to about 2000 v/v.

19. The process according to claim 4, wherein a hydrotreating catalyst comprises a support, one or both of molybdenum and tungsten, and one or both of nickel and cobalt supported thereon, wherein the support comprises alumina and zeolite, with a weight ratio of the alumina to the zeolite ranging from about 90:10 to about 50:50, wherein the alumina comprises a small pore alumina and a large pore alumina in a weight ratio ranging from about 75:25 to about 50:50, wherein the small pore alumina comprises about 95% or more by volume of pores with a diameter less than about 80 angstroms based on a total volume of the pores, and the large pore alumina comprises about 70% or more by volume of pores with a diameter of about 60 to about 600 angstroms based on the total volume of the pores.

20. The process according to claim 19, wherein the hydrotreating catalyst comprises oxides of molybdenum and/or tungsten in an amount of about 10 wt % to about 35 wt %, and oxides of nickel and/or cobalt in an amount of about 1 wt % to about 15 wt %, wherein the weight percentage is calculated based on a total weight of the hydrotreating catalyst.

21. The process according to claim 19, wherein the weight ratio of the alumina to the zeolite ranges from about 90:10 to about 60:40.

22. The process according to claim 19, wherein the zeolite is a Y-type zeolite.

23. The process according to claim 2, wherein the fluid catalytic cracking gas oil is subject to a cracking reaction in the second conversion reactor to produce oil vapors, wherein the oil vapors are subject to a hydrogen transfer reaction and an isomerization reaction to produce a gasoline product.

24. The process according to claim 23, wherein the cracking reaction has a reaction temperature ranging from about 480° C. to about 600° C., a reaction time ranging from about 0.1 to about 3 seconds, a ratio by weight of the conversion catalyst to the fluid catalytic cracking gas oil ranging from about 0.5 to about 25:1, a ratio by weight of a prelifting medium to the fluid catalytic cracking gas oil ranging from about 0.01 to about 2:1.

25. The process according to claim 23, wherein the hydrogen transfer reaction and the isomerization reaction are carried out at a reaction temperature ranging from about 450° C. to about 550° C., and a weight hourly space velocity ranging from about 1 $h^{-1}$ to about 50 $h^{-1}$.

* * * * *